US009041757B2

(12) United States Patent
Hayakawa et al.

(10) Patent No.: US 9,041,757 B2
(45) Date of Patent: May 26, 2015

(54) IMAGE FORMING APPARATUS IN WHICH THE LIGHT IRRADIATED ON A NON-IMAGING PORTION IS ADJUSTED

(71) Applicant: CANON KABUSHIKI KAISHA, Tokyo (JP)

(72) Inventors: Masahiro Hayakawa, Odawara (JP); Kengo Kawamoto, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/910,854

(22) Filed: Jun. 5, 2013

(65) Prior Publication Data

US 2013/0328992 A1 Dec. 12, 2013

(30) Foreign Application Priority Data

Jun. 8, 2012 (JP) ..... 2012-131294
May 9, 2013 (JP) ..... 2013-099735

(51) Int. Cl.
*B41J 2/435* (2006.01)
*B41J 2/47* (2006.01)
*G03G 15/00* (2006.01)
*G03G 15/047* (2006.01)

(52) U.S. Cl.
CPC ..... *G03G 15/80* (2013.01); *G03G 15/047* (2013.01); *G03G 2215/0132* (2013.01)

(58) Field of Classification Search
USPC ..... 347/228, 233–237, 240, 246–254
See application file for complete search history.

(56) References Cited

U.S. PATENT DOCUMENTS 5,740,502 A 4/1998 Kobayashi et al.
5,900,901 A * 5/1999 Costanza et al. ..... 347/248
6,137,522 A 10/2000 Melino et al.
6,188,419 B1 2/2001 Katamoto et al.
6,226,019 B1 * 5/2001 Nakano ..... 347/131
6,501,493 B2 12/2002 Fujimoto et al.
6,606,470 B1 8/2003 Wibbels et al.

(Continued)

FOREIGN PATENT DOCUMENTS

JP H08-337007 A 12/1996
JP 2001-281944 A 10/2001

(Continued)

OTHER PUBLICATIONS

U.S. Appl. No. 13/910,833, filed Jun. 5, 2013, Ryuhei Shoji.

*Primary Examiner* — Hai C Pham
(74) *Attorney, Agent, or Firm* — Canon USA Inc IP Division

(57) ABSTRACT

An image forming apparatus including a control unit configured to cause the light irradiation unit to irradiate the photosensitive member at an image forming portion to which toner particles adhere with light emitted from the light source by a first light emission amount, and cause the light irradiation unit to irradiate the photosensitive member at a non-image forming portion to which no toner particles adhere with light emitted from the light source by a second light emission amount that is smaller than the first light emission amount. The image forming apparatus further includes an adjusting unit configured to adjust the first light emission amount and the second light emission amount, and an acquisition unit configured to acquire information relating to a speed of surface of the photosensitive member. The adjusting unit is configured to change the second light emission amount according to information acquired by the acquisition unit.

13 Claims, 19 Drawing Sheets

(56) References Cited

U.S. PATENT DOCUMENTS

| | | | | |
|---|---|---|---|---|
| 8,120,825 | B2 | 2/2012 | Akamatsu | |
| 8,493,425 | B2 * | 7/2013 | Furuta | 347/233 |
| 2008/0122918 | A1 | 5/2008 | Sakai et al. | |
| 2008/0175608 | A1 | 7/2008 | Kobashigawa | |
| 2012/0147119 | A1 | 6/2012 | Toyoizumi et al. | |
| 2012/0230705 | A1 | 9/2012 | Shimura et al. | |
| 2012/0300009 | A1 * | 11/2012 | Toyoizumi et al. | 347/118 |

FOREIGN PATENT DOCUMENTS

| | | | |
|---|---|---|---|
| JP | 2006-39026 | A | 2/2006 |
| JP | 2008-134326 | A | 6/2008 |
| JP | 2008-181101 | A | 8/2008 |
| JP | 2009-255534 | A | 11/2009 |

* cited by examiner

FIG. 12

| NUMBER OF DRUM ROTATIONS (×1000) | WEAK EXPOSURE | | ORDINARY EXPOSURE | | | | |
|---|---|---|---|---|---|---|---|
| | | | ORDINARY EXPOSURE (DENSITY 0%) | | ORDINARY EXPOSURE (DENSITY 100%) | | LIGHT EMISSION LUMINANCE (mW) (ADDITIONAL LIGHT EMISSION LUMINANCE) |
| | μJ/cm² | LIGHT EMISSION LUMINANCE (mW) | μJ/cm² | % (PWM) | μJ/cm² | % (PWM) | |
| 0≦r<37.5 | 0.030 | 0.42 (Vref21=0.31 V, PWN2:79.2%) | 0 | 0 | 0.25 | 100 | 3.50 (3.08 (Vref11=0.81 V, PWM1:46.1%)) |
| 37.5≦r<75 | 0.047 | 0.66 (Vref21=0.49 V, PWN2:67.4%) | 0 | 0 | 0.30 | 100 | 4.2 (3.54 (Vref11=0.93 V, PWM1:38.0%)) |
| 75≦r<112.5 | 0.068 | 0.95 (Vref21=0.71 V, PWN2:52.8%) | 0 | 0 | 0.36 | 100 | 5.04 (4.09 (Vref11=1.07 V, PWM1:28.4%)) |
| 112.5≦r<150 | 0.093 | 1.30 (Vref21=0.97 V, PWN2:35.4%) | 0 | 0 | 0.41 | 100 | 5.74 (4.44 (Vref11=1.16 V, PWM1:22.3%)) |
| 150≦r | 0.120 | 1.68 (Vref21=1.25 V, PWN2:16.7%) | 0 | 0 | 0.46 | 100 | 6.44 (4.76 (Vref11=1.25 V, PWM1:16.7%)) |

FIG. 13

| PROCESS SPEED RATIO | THINNING-OUT | LIGHT EMISSION LUMINANCE RATIO |
|---|---|---|
| 1/3 | 2 | 1.0[=1/3*(2+1)] |
| 1/2 | 1 | 1.0[=1/2*(1+1)] |
| 3/5 | 1 | 1.2[=3/5*(1+1)] |
| 4/5 | 0 | 0.8[=4/5*(0+1)] |
| 1/1 | 0 | 1.0[=1/1*(0+1)] |

FIG. 14

| PROCESS SPEED RATIO | THINNING-OUT | WEAK EXPOSURE | | ORDINARY EXPOSURE | | | | |
|---|---|---|---|---|---|---|---|---|
| | | | | ORDINARY EXPOSURE (DENSITY 0%) | | ORDINARY EXPOSURE (DENSITY 100%) | | LIGHT EMISSION LUMINANCE (mW) (ADDITONAL LIGHT EMISSION LUMINANCE) |
| | | μJ/cm² | LIGHT EMISSION LUMINANCE (mW) | μJ/cm² | % (PWM) | μJ/cm² | % (PWM) | |
| 1/3 | 2 | 0.040 | 1.68 (Vref21=1.25 V, PWN2:16.7%) | 0 | 0 | 0.15 | 100 | 6.44 (4.76 (Vref11=1.25 V, PWM1:16.7%)) |
| 1/2 | 1 | 0.060 | 1.68 (Vref21=1.25 V, PWN2:16.7%) | 0 | 0 | 0.23 | 100 | 6.44 (4.76 (Vref11=1.25 V, PWM1:16.7%)) |
| 3/5 | 1 | 0.072 | 2.016 (Vref21=1.51 V, PWN2:0%) | 0 | 0 | 0.28 | 100 | 7.728 (5.712 (Vref11=1.5 V, PWM1:0%)) |
| 4/5 | 0 | 0.096 | 1.344 (Vref21=1.00 V, PWN2:33.3%) | 0 | 0 | 0.37 | 100 | 5.152 (3.808 (Vref11=1.00 V, PWM1:33.3%)) |
| 1/1 | 0 | 0.120 | 1.68 (Vref21=1.25 V, PWN2:16.7%) | 0 | 0 | 0.46 | 100 | 6.44 (4.76 (Vref11=1.25 V, PWM1:16.7%)) |

FIG. 15

| NUMBER OF DRUM ROTATIONS (×1000) | WEAK EXPOSURE | ORDINARY EXPOSURE | |
|---|---|---|---|
| | LIGHT EMISSION LUMINANCE RATIO | LIGHT EMISSION LUMINANCE RATIO | LIGHT EMISSION LUMINANCE RATIO (ADDITIONAL LIGHT EMISSION LUMINANCE) |
| $0 \leqq r < 37.5$ | 0.25 | 0.54 | 0.65 |
| $37.5 \leqq r < 75$ | 0.39 | 0.65 | 0.74 |
| $75 \leqq r < 112.5$ | 0.57 | 0.78 | 0.86 |
| $112.5 \leqq r < 150$ | 0.77 | 0.89 | 0.93 |
| $150 \leqq r$ | 1.0 | 1.0 | 1.0 |

FIG. 17

| PROCESS SPEED RATIO | SCANNING LINE THINNING-OUT | LIGHT EMISSION LUMINANCE RATIO |
|---|---|---|
| 1/3 | 2 | 1.0[=1/3*(2+1)] |
| 1/2 | 1 | 1.0[=1/2*(1+1)] |
| 3/5 | 1 | 1.2[=3/5*(1+1)] |
| 4/5 | 0 | 0.8[=4/5*(0+1)] |
| 1/1 | 0 | 1.0[=1/1*(0+1)] |

IMAGE FORMING APPARATUS IN WHICH THE LIGHT IRRADIATED ON A NON-IMAGING PORTION IS ADJUSTED

BACKGROUND OF THE INVENTION

1. Field of the Invention

The present disclosure relates to an image forming apparatus, such as a laser printer, a copy machine, or a facsimile machine, which is operable according to an electronic photographic recording method.

2. Description of the Related Art

An image forming apparatus (e.g., a copy machine or a laser printer) that performs operations according to an electronic photographic recording method is conventionally known. For example, the image forming apparatus performs the following electronic photographic processes according to the electronic photographic recording method. First, a charging device uniformly charges the surface of a photosensitive drum, for example, to have an electric potential of −600 V. Subsequently, a laser exposure device forms an electrostatic latent image on the photosensitive drum with laser light. Then, a developing device develops the electrostatic latent image with toner particles to form a toner image. A transfer device transfers the toner image onto a recording member.

Further, for example, as discussed in Japanese Patent Application Laid-Open No. 2001-281944, a drum cleaning device removes remaining toner particles off the photosensitive drum and a pre-exposure lamp irradiates the photosensitive drum with light to neutralize the drum surface as a preparation for the next image forming operation.

In forming an electrostatic latent image on a photosensitive member surface, controlling the charging potential of the photosensitive member surface beforehand is important for the above-mentioned image forming apparatus that is operable according to the electronic photographic recording method. For example, in performing the above-mentioned charging potential control, the above-mentioned pre-exposure lamp and other various control methods are available. However, it is desired to employ a simplified configuration that can reduce the costs of the entire apparatus and downsize the apparatus body.

The printers that are popular and mostly used in recent years are color printers. In general, the control for a color printer includes changing the processing speed to process various types of recording media (e.g., rough papers and gloss papers) in addition to plain papers. Further, in some cases, it is desired to differentiate the processing speed to be set for monochrome printing from the processing speed to be set for color printing. As mentioned above, the color printer is required to perform complicated operations/controls to realize various processing speeds.

SUMMARY OF THE INVENTION

An embodiment of the present invention is directed to a technique capable of solving at least one of the above-mentioned problems and other related problems. For example, an embodiment of the present invention is directed to a technique capable of appropriately controlling the charging potential of each photosensitive member in such a way as to realize various processing speeds, with a simplified configuration.

According to an aspect of the present invention, an image forming apparatus includes a photosensitive member, a charging unit configured to charge the photosensitive member, a light irradiation unit configured to irradiate the photosensitive member charged by the charging unit with light emitted from a light source to form a latent image, and a developing unit configured to form a toner image by causing toner particles to adhere to the latent image. The image forming apparatus further includes a control unit configured to cause the light irradiation unit to irradiate the photosensitive member at an image forming portion to which toner particles adhere with light emitted from the light source by a first light emission amount, and cause the light irradiation unit to irradiate the photosensitive member at a non-image forming portion to which no toner particles adhere with light emitted from the light source by a second light emission amount that is smaller than the first light emission amount. The image forming apparatus further includes an adjusting unit configured to adjust the first light emission amount and the second light emission amount, and an acquisition unit configured to acquire information relating to a speed of surface of the photosensitive member. The adjusting unit is configured to change the second light emission amount according to the information acquired by the acquisition unit.

The image forming apparatus according to an embodiment of the present invention can appropriately control the charging potential of each photosensitive member to realize various print speeds, with a simplified configuration, and can solve the problems that may occur due to the charging potential of the photosensitive drum.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 12 illustrates a table that includes photosensitive drum operating conditions in association with ordinary exposure parameters and weak exposure parameters.

FIG. 13 illustrates a table that includes various combinations of processing speed ratio and thinning-out, in association with light emission luminance ratio.

FIG. 14 illustrates a table that includes various processing speed ratios in association with ordinary exposure parameters and weak exposure parameters.

FIG. 15 illustrates a table that includes photosensitive drum operating conditions in association with light emission luminance ratios in weak exposure and ordinary exposure.

FIG. 17 illustrates a table that includes various combinations of processing speed ratio and scanning line thinning-out, in association with light emission luminance ratio.

DESCRIPTION OF THE EMBODIMENTS

Various exemplary embodiments, features, and aspects of the invention will be described in detail below with reference to the drawings. However, constituent components described in the following exemplary embodiments are mere examples. The scope of the present invention is not limited to the following exemplary embodiments.

A configuration example of a color image forming apparatus (hereinafter, simply referred to as "image forming apparatus") according to a first exemplary embodiment is described in detail below with reference to FIGS. 1 to 10. Further, a weak exposure related control operation is described in detail below with reference to FIGS. 11 to 13.

<Schematic Cross-Sectional View of Image Forming Apparatus>

Figure 1:
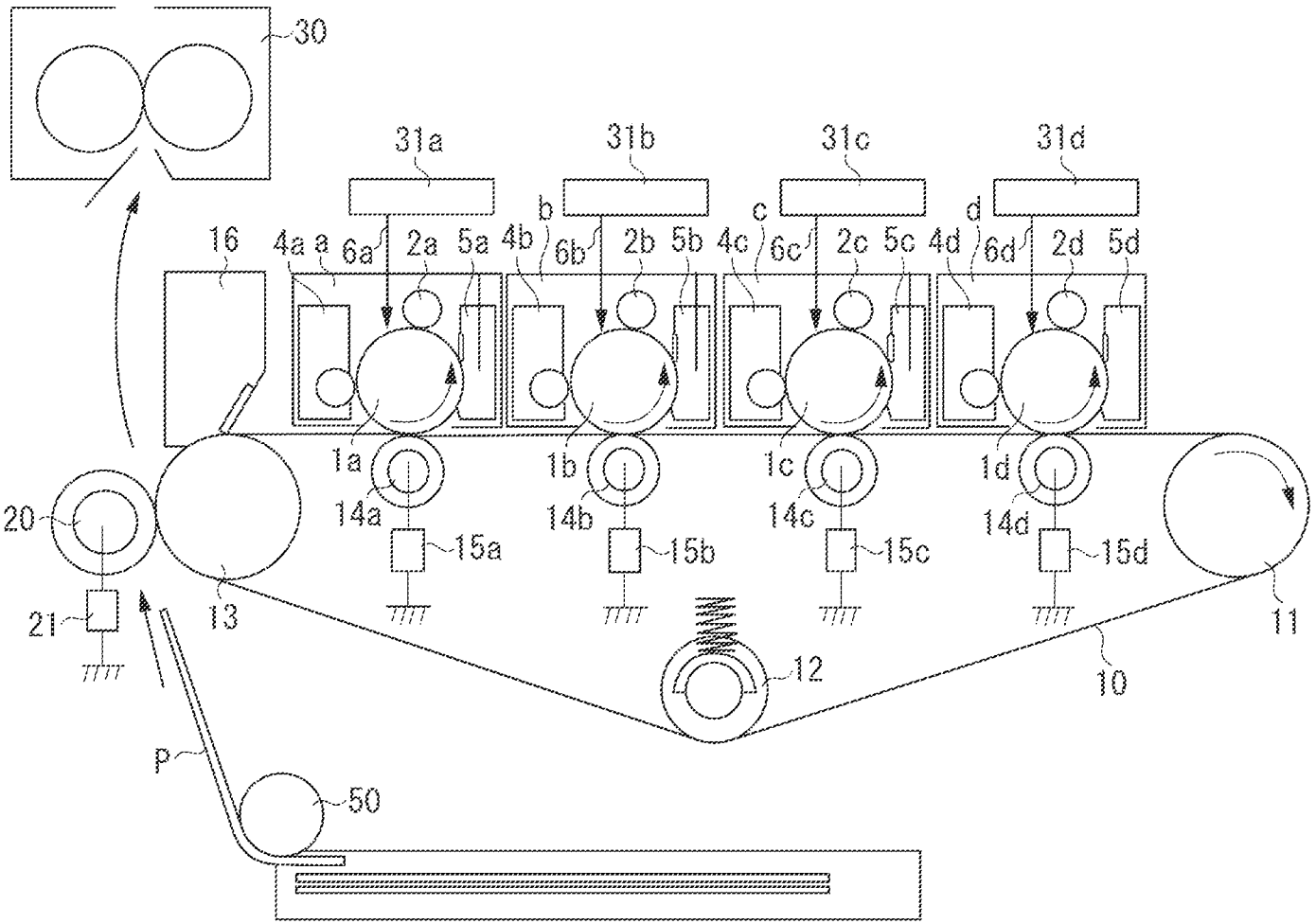
FIG. 1 illustrates a schematic view of a color image forming apparatus, which includes a cross-sectional view of photosensitive drums.

FIG. 1 is a schematic cross-sectional view illustrating the image forming apparatus. A system configuration of and operations to be performed by the image forming apparatus according to the present exemplary embodiment are described in detail below with reference to FIG. 1. The image forming apparatus includes first to fourth ("a" to "d") image forming stations. The first image forming station is dedicated to yellow (hereinafter, referred to as "Y"). The second image forming station is dedicated to magenta (hereinafter, referred to as "M"). The third image forming station is dedicated to cyan (hereinafter, referred to as "C"). The fourth image forming station is dedicated to black (hereinafter, referred to as "Bk").

Each of the image forming stations "a" to "d" includes a storage member, such as a memory tag (not illustrated), which stores information indicating the life span of a corresponding photosensitive drum. For example, the image forming stations "a" to "d" store information indicating the cumulative number of rotations of corresponding photosensitive drums 1*a* to 1*d*, respectively. In the following description, attached suffixes "a" to "d" may be omitted unless they are necessary to discriminate respective photosensitive drums. Each image forming station is attachable to and detachable from the image forming apparatus body. Further, each image forming station may include additional exchangeable member in addition to the photosensitive drum 1.

In the following description, the first image forming station (Y) "a" is described as a representative image forming station. The image forming station "a" includes the photosensitive drum 1*a*, which serves as a photosensitive member. The photosensitive drum 1*a* is rotatable, when it is driven, in an arrow direction at a predetermined rotational rate with a predetermined tangential speed (hereinafter, referred to as "processing speed"). The tangential speed of the photosensitive drum 1*a* (i.e., the speed of the surface of the photosensitive drum 1) is substantially equal to a moving speed of the intermediate transfer belt 10. In this respect, the tangential speed of the photosensitive drum 1*a* can be referred to as a transfer speed. Further, a tangential speed of the secondary transfer roller 20 and a moving speed of a recording material P are substantially equal to the transfer speed.

While the photosensitive drum 1*a* is rotating about its rotational axis, a charging roller 2*a* uniformly charges the photosensitive drum 1*a* to have a charging potential Vd of a predetermined polarity. An exposure device 31*a* is operable as an exposure unit configured to perform an exposure operation based on image data (i.e., an image signal) that can be supplied from an external device. The exposure device 31*a* can expose an image forming portion of the photosensitive drum 1*a* surface with scanning laser light 6*a* by an exposure amount E ($\mu J/cm^2$) in such a way as to neutralize electric charges and form an exposure potential Vl (VL) on the photosensitive drum 1*a* surface.

Further, the exposure device 31*a* can weakly expose a non-image forming portion of the photosensitive drum 1*a* surface with the scanning laser light 6*a* by an exposure amount Ebg ($\mu J/cm^2$) (Ebg<E) in such a way as to form a post weak-exposure charging potential Vd_bg.

Subsequently, toner particles adhere to the portion having the exposure potential Vl (VL) to develop and visualize the image forming portion due to a potential difference between a developing potential Vdc applied to a developing device (i.e., a yellow developing device) 4*a* serving as a first developing unit and the exposure potential Vl (VL).

No toner particles adhere to the non-image forming portion having the potential Vd_bg because a potential difference between the developing potential Vdc and the potential Vd_bg is insufficient. In other words, no positive or reversal fogging occurs at the potential Vd_bg. More specifically, the charging potential Vd is set to be approximately in a range from −700 V to −600 V. The post weak-exposure charging potential Vd_bg is set to be approximately in a range from −550 V to −400 V. The developing potential Vdc is set to be approximately −350 V. The exposure potential Vl is set to be approximately −150 V.

The image forming apparatus according to the present exemplary embodiment is a reversal development image forming apparatus that performs an image exposure operation with the exposure device 31*a* to develop a toner image at a portion to be exposed.

The intermediate transfer belt 10 is stretched by a plurality of stretch members 11, 12, and 13 in such a way as to contact the photosensitive drum 1*a*. The intermediate transfer belt 10 is rotatable, when it is driven, together with the photosensitive drum 1*a* in the same direction and at substantially the same speed as the tangential speed of the photosensitive drum 1*a*, while the intermediate transfer belt 10 contacts the photosensitive drum 1*a* at the contact position.

A yellow toner image formed on the photosensitive drum 1*a* can be transferred in the following manner. More specifically, when the yellow toner image passes through the portion where the photosensitive drum 1*a* contacts the intermediate transfer belt 10 (hereinafter, referred to as "primary transfer nip portion"), the yellow toner image is primarily transferred to the intermediate transfer belt 10 while a primary transfer power source 15*a* applies a primary transfer voltage to a primary transfer roller 14*a*.

A drum cleaner 5*a*, which serves as a cleaning unit configured to clean the photosensitive drum 1*a*, removes residual toner off the surface of the photosensitive drum 1*a*. Subsequently, the image forming station "a" repetitively performs the above-mentioned charging and other image forming processes.

Similarly, the image forming station "b" forms a magenta toner image (M) as the second color. The image forming station "c" forms a cyan toner image (C) as the third color. The image forming station "d" forms a black toner image (Bk) as the fourth color. The toner images formed in this manner are successively transferred to the intermediate transfer belt 10 in an overlap fashion to obtain a composite color image.

The four-color toner images formed on the intermediate transfer belt 10 pass through a contact portion where the intermediate transfer belt 10 contacts the secondary transfer roller 20 (hereinafter, referred to as "secondary transfer nip portion"), in a state where a secondary transfer power source 21 applies a secondary transfer voltage to the secondary transfer roller 20.

Thus, the four-color toner images can be transferred from the intermediate transfer belt 10 to the recording material P that can be supplied via a paper feeder roller 50. Subsequently, the recording material P carrying the four-color toner images thereon is guided into a fixing device 30, in which the recording material P is heated and pressed. Therefore, the four-color toner particles are melted and mixed together and fixed on the recording material P. Through the above-mentioned operational processes, a full-color toner image can be formed on a recording medium (i.e., the recording material P). A belt cleaner 16, which serves as a cleaning unit configured to clean the intermediate transfer belt 10, removes secondary transfer toner residue off the surface of the intermediate transfer belt 10.

<Photosensitive Drum Sensitivity Characteristics>

Figure 2:
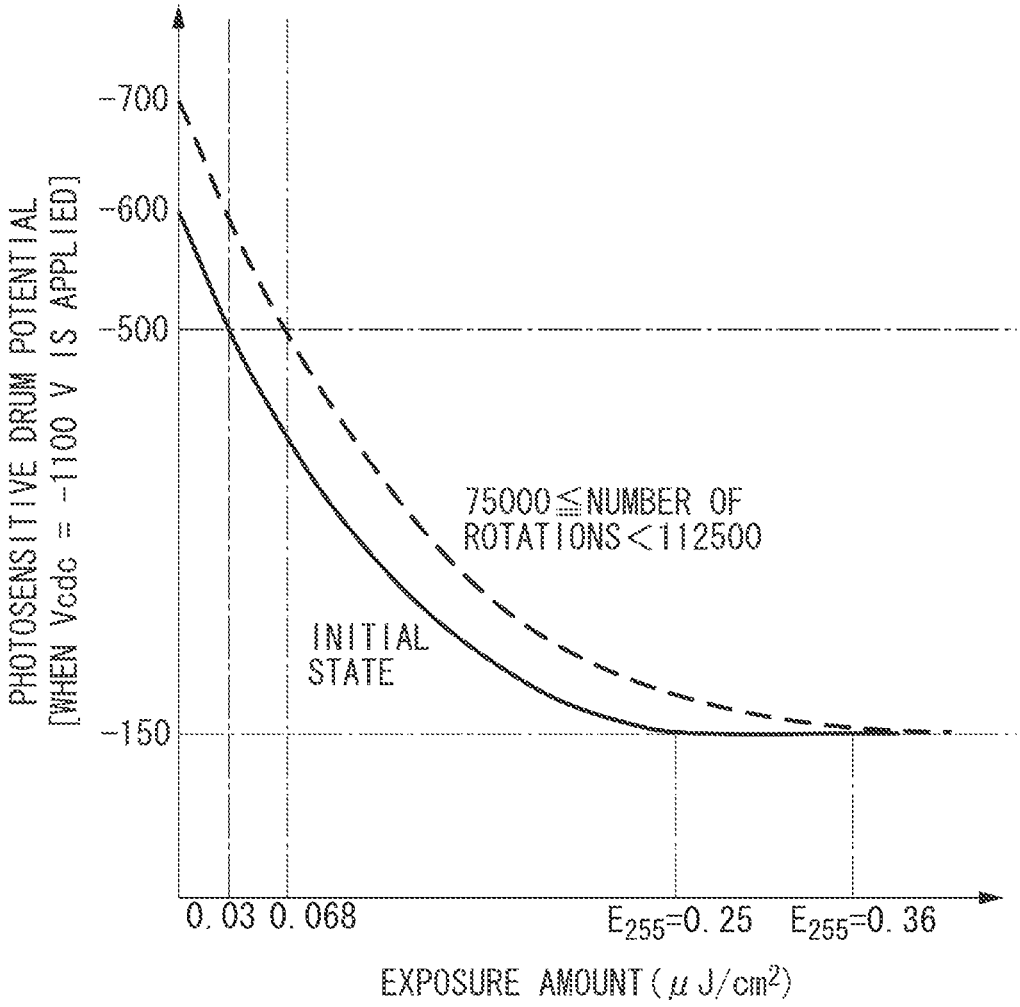
FIG. 2 is a graph illustrating an example of photosensitive drum sensitivity characteristics (i.e., an EV curve).

FIG. 2 is a graph illustrating an example of an EV curve that represents photosensitive characteristics of the photosensitive drum 1, in which the abscissa axis refers to exposure amount E ($\mu J/cm^2$) and the ordinate axis refers to photosensitive drum potential (V). In FIG. 2, Vcdc represents the charging voltage applied to the photosensitive drum 1. According to the example illustrated in FIG. 2, the charging voltage Vcdc is equal to −1100 V.

FIG. 2 illustrates a potential attenuation that can be obtained when the photosensitive drum 1 is exposed with the laser light after the drum surface is charged to have an electric potential V, in such a way that the exposure amount on the photosensitive drum surface becomes E ($\mu J/cm^2$). The EV curve illustrated in FIG. 2 indicates that a large potential attenuation can be obtained by increasing the exposure amount E.

Further, the recombination of charge carriers (electron-hole pair) does not occur so easily at a high-potential portion because of the intense electric field environment. Therefore, even if the exposure amount is small, it is feasible to obtain a larger potential attenuation. On the other hand, the recombination of generation carriers tends to occur at a low-potential portion. Therefore, the potential attenuation is smaller even when the exposure amount is large.

In FIG. 2, one EV curve indicates photosensitive characteristics of the photosensitive drumlin an initial stage where using the photosensitive drum 1 has been just started and another EV curve indicates photosensitive characteristics of the photosensitive drum 1 that has been continuously used for a significant long duration.

For example, in FIG. 2, the EV curve indicated by a dotted line can be obtained when the number of rotations "r" of the photosensitive drum is in a range of $75{,}000 \leq r < 112{,}500$. The EV curves illustrated in FIG. 2 are mere examples indicating the photosensitive drum sensitivity characteristics. Application of photosensitive drums having photosensitive characteristics indicated by various EV curves can be presumed in the present exemplary embodiment.

<Charging/Developing High-Voltage Power Source>

Next, examples of the charging/developing high-voltage power source are described with reference to FIGS. 3A and 3B. According to the example illustrated in FIG. 3A, a plurality of charging rollers 2*a* to 2*d* corresponding to respective colors and a plurality of developing rollers 43*a* to 43*d* corresponding to respective colors are connected to a charging/developing high-voltage power source 52. The charging/developing high-voltage power source 52 includes a transformer 53 that can supply the charging voltage Vcdc (i.e., a power source voltage) to the charging rollers 2*a* to 2*d*.

Further, the charging/developing high-voltage power source 52 includes two resistor elements R3 and R4 that can supply a divided voltage as a developing voltage Vdc to the developing rollers 43*a* to 43*d*.

Figure 3A:
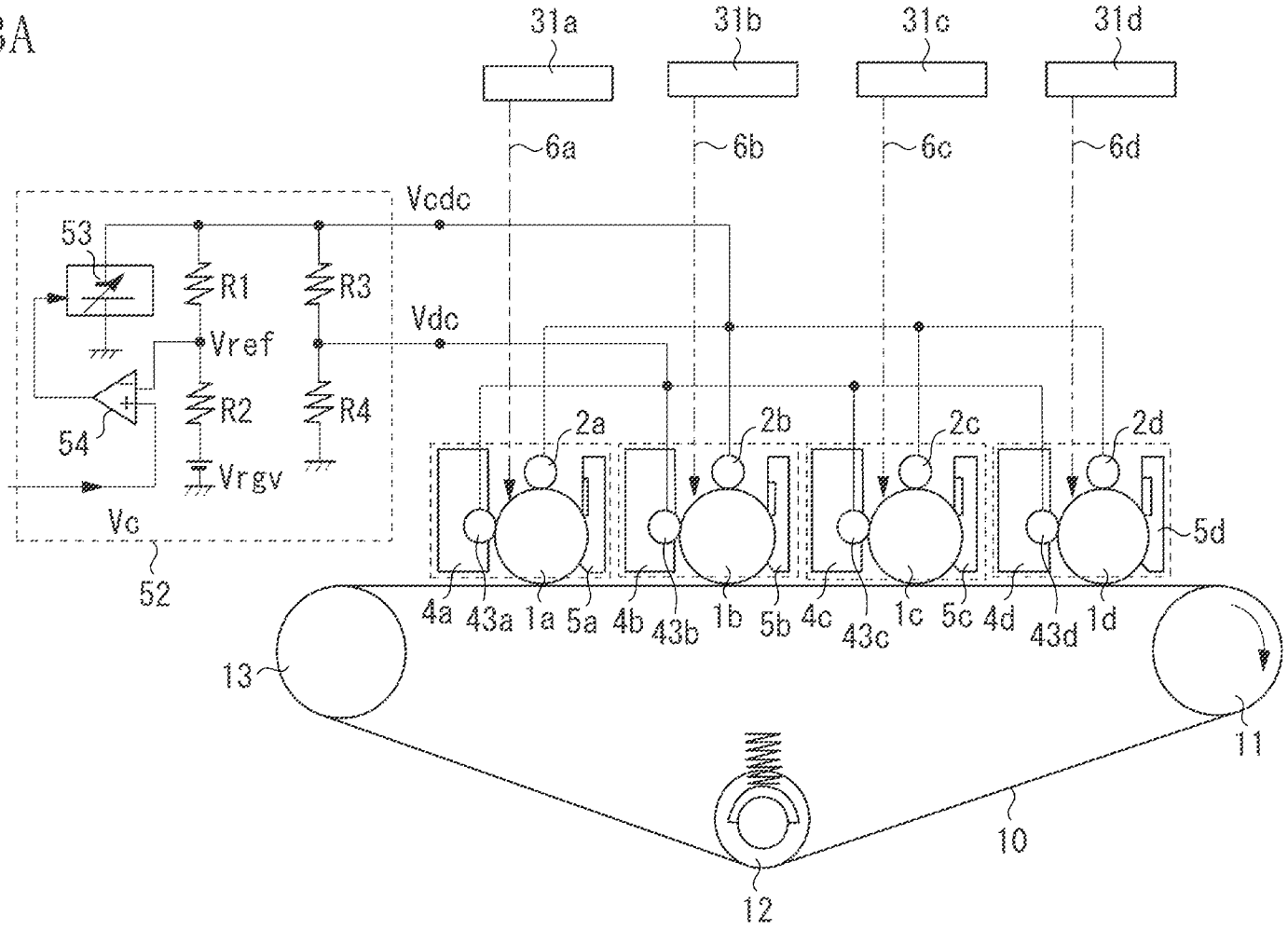
FIGS. 3A and 3B illustrate high-voltage power source circuits provided for charging rollers and developing rollers.
Figure 3B:
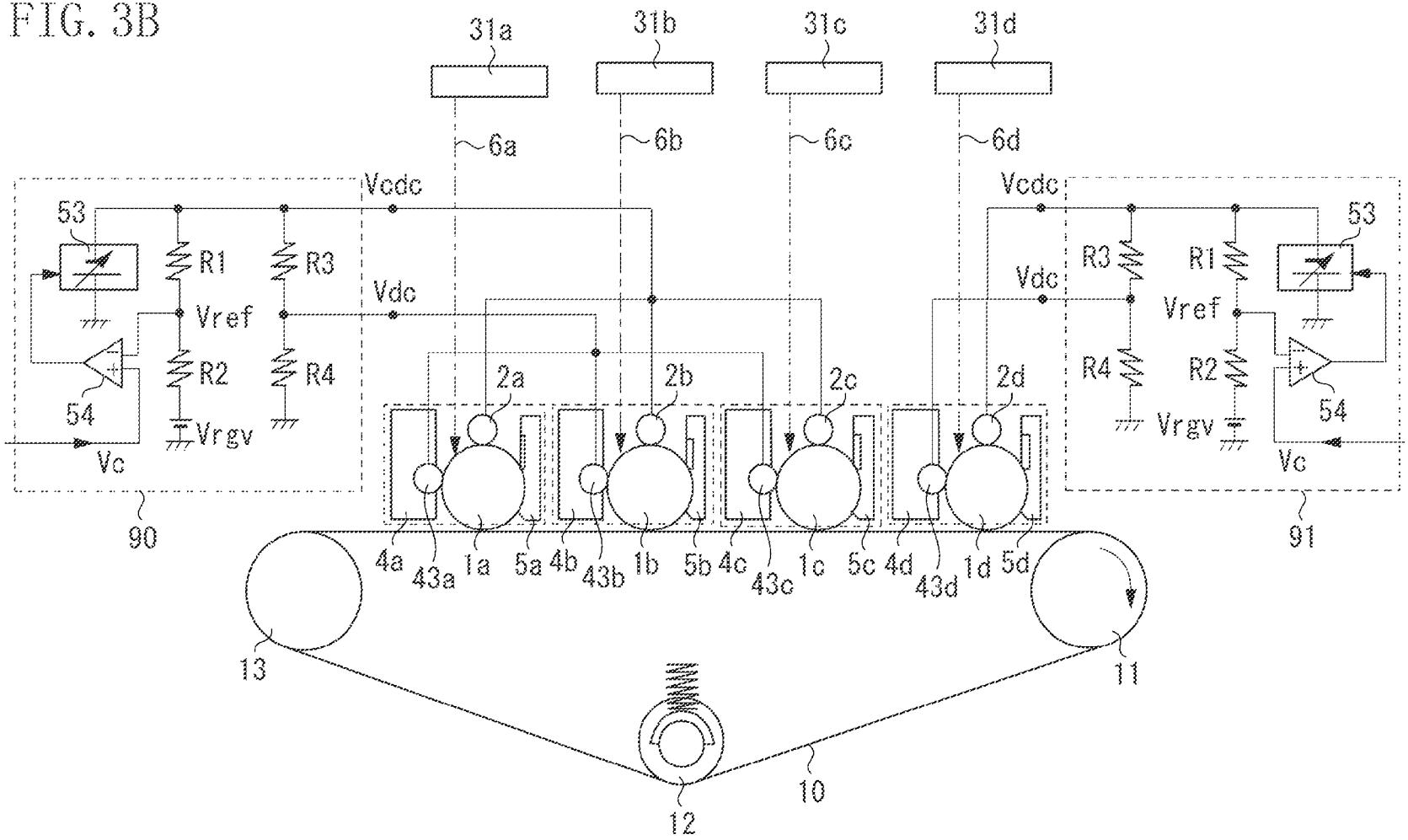

In the power source circuits illustrated in FIGS. 3A and 3B, the power source system is simplified. Therefore, the voltages to be input (applied) to respective rollers can be simultaneously adjusted while maintaining a predetermined relationship between them. On the other hand, it is difficult to perform an individual adjusting (i.e., an individual control) for respective colors. Further, a similar configuration is employed for the developing rollers 43.

The resistor elements R3 and R4 can be fixed resistors, pre-set variable resistors, or variable resistors. Further, as illustrated in the drawings, the power source voltage is directly applied from the transformer 53 to the charging rollers 2*a* to 2*d*. The divided voltage, which can be obtained by dividing the output voltage of the transformer 53 with the fixed voltage-dividing resistors, is directly applied to the developing rollers 43*a* to 43*d*. However, the above-mentioned circuit arrangement is a mere example. Any other voltage input circuit arrangement is employable to apply voltages to respective rollers (i.e., a charging unit ora developing unit).

For example, the following configuration is employable instead of using the output voltage of the transformer 53. More specifically, a DC-DC converter can be provided to convert the output voltage of the transformer 53 into a converted voltage. Further, an electronic element having stationary voltage drop characteristics can be provided to apply a divided or reduced voltage obtainable from the power source voltage or the converted voltage to the charging rollers 2*a* to 2*d*.

Similarly, a DC-DC converter can be provided to convert the output voltage of the transformer 53 into a converted voltage. An electronic element having stationary voltage drop characteristics can be provided to apply a divided or reduced voltage obtainable from the power source voltage or the converted voltage to the developing rollers 43*a* to 43*d*. In the present exemplary embodiment, the electronic element having stationary voltage drop characteristics is, for example, a resistor element or a Zener diode. Further, a variable regulator is usable as the converter. For example, the divided voltage can be further reduced when the voltage is divided and/or reduced by the electronic element.

On the other hand, to control the charging voltage Vcdc to be substantially constant, a negative voltage obtainable by reducing the charging voltage Vcdc at a ratio R2/(R1+R2) is offset by a reference voltage Vrgv to obtain a monitor voltage Vref having a positive polarity. A feedback control is performed in such a way as to set the monitor voltage Vref to be a constant value.

More specifically, a control voltage Vc being set beforehand by an engine controller 122 (including a central processing unit (CPU)) (see FIG. 5) is input to a positive terminal of an operational amplifier 54. On the other hand, the monitor voltage Vref is input to a negative terminal of the operational amplifier 54. The engine controller 122 changes the control voltage Vc appropriately according to an operational situation. Then, a control/driving system for the transformer 53 is feedback controlled based on the output value of the operational amplifier 54 in such a way as to equalize the monitor voltage Vref with the control voltage Vc. Thus, the charging voltage Vcdc output from the transformer 53 can be controlled to have a target value.

In the output control of the transformer 53, it is also useful to supply the output of the operational amplifier 54 to the CPU so that a calculation result obtained by the CPU can be reflected in the control/driving system for the transformer 53. In the present exemplary embodiment, the control is performed to set the charging voltage Vcdc to −1100 V and set the developing voltage Vdc to −350 V. Under the above-mentioned control, the charging rollers 2*a* to 2*d* can uniformly charge the surfaces of the photosensitive drums 1*a* to 1*d* to have the charging potential Vd.

FIG. 3B illustrates another example of the charging/developing high-voltage power source. In FIGS. 3A and 3B, same or similar members are denoted by the same reference numerals. Therefore, redundant description thereof will be avoided. In FIG. 3B, at least two power sources are used. A charging/developing high-voltage power source 90 is dedicated to the image forming stations of Y, M, and C colors. A charging/developing high-voltage power source 91 is dedicated to the image forming station of Bk color.

Both the charging/developing high-voltage power sources 90 and 91 are turned on when the image forming apparatus performs a full-color mode image forming operation. Only the charging/developing high-voltage power source 91 dedicated to the image forming station of Bk color is turned on when the image forming apparatus performs a monochrome mode image forming operation. In other words, the charging/developing high-voltage power source 90 dedicated to the image forming stations of Y, M, and C colors is not activated (is turned off).

In FIG. 3B, the charging/developing high-voltage power source 90 dedicated to the image forming stations of Y, M, and C colors is substantially similar to the charging/developing high-voltage power source 52 illustrated in FIG. 3A.

As mentioned above, according to the examples illustrated in FIGS. 3A and 3B, the same high-voltage power source is commonly used for a plurality of charging rollers and a plurality of developing rollers. In this respect, the arrangements illustrated in FIGS. 3A and 3B are useful in downsizing the image forming apparatus.

Further, the arrangements illustrated in FIGS. 3A and 3B are useful in suppressing the costs, compared to a case where a transformer capable of changing an output voltage for each color is provided to control the input voltage applied to each charging roller or each developing roller independently. Further, the arrangements illustrated in FIGS. 3A and 3B are useful in suppressing the costs compared to a case where a DC-DC converter (e.g., a variable regulator) is provided for each charging roller or each developing roller to control an output of a transformer for each charging roller or a developing roller independently.

<Appearance of Optical Scanning Device>

Figure 4:
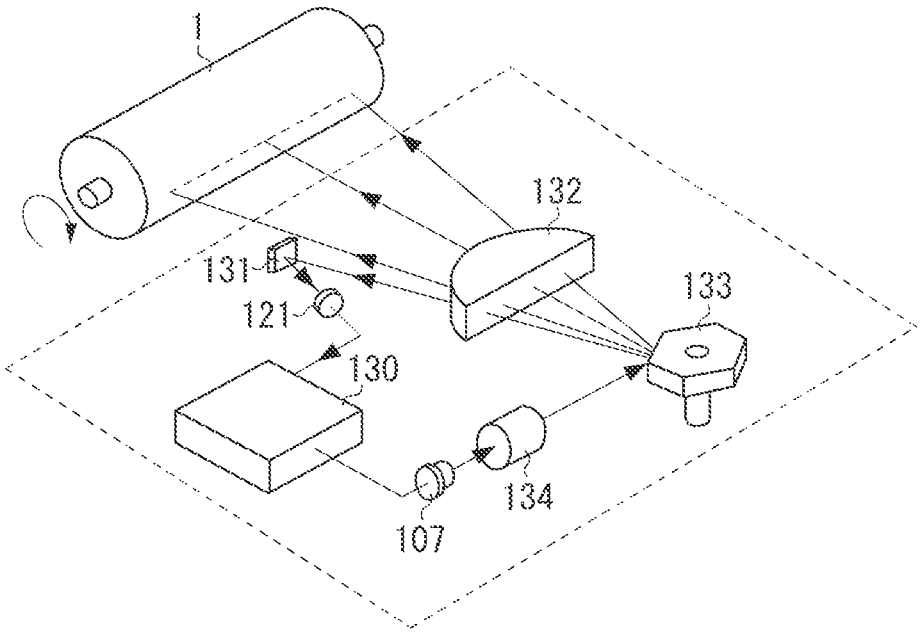
FIG. 4 illustrates an appearance of an optical scanning device.

FIG. 4 illustrates a representative appearance of an optical scanning device. A laser driving system circuit 130 is configured to operate in such a way as to supply drive current that flows through a laser diode 107 (hereinafter, referred to as "LD 107"), which is a light emitting element (e.g., a light source). The LD 107 emits laser light having an intensity level that corresponds to the drive current. The laser driving system circuit 130 (hereinafter, referred to as "the LD driver 130") is a circuit configured to drive the LD 107 that is electrically connected to the engine controller 122 and a video controller 123.

A collimator lens 134 can change the beam shape of the laser light emitted from the LD 107 into a parallel beam. A polygonal mirror 133 can reflect the parallel beam in such a way as to realize scanning in the horizontal direction of the photosensitive drum 1. Then, the scanning laser light passes through an fθ lens 132. The surface of the photosensitive drum 1 is exposed with the scanning laser light in a dot fashion in such a way that an image is formed on the drum surface while the drum 1 is rotating around its rotational axis in an arrow direction.

A reflection mirror 131 is provided at a portion corresponding to a scanning position on one end of the photosensitive drum 1. The reflection mirror 131 reflects the laser light projected to a scanning start position toward a BD synchronization detection sensor 121 (hereinafter, referred to as "BD detection sensor"). The BD detection sensor 121 generates an output that determines laser scanning start timing. In forcible light emission to be performed to detect the laser light, an auto power control (APC), which is an automatic light quantity control for setting the laser light quantity to a desired light quantity, is performed to adjust the laser emission level.

<Laser Driving System Circuit>

Figure 5:
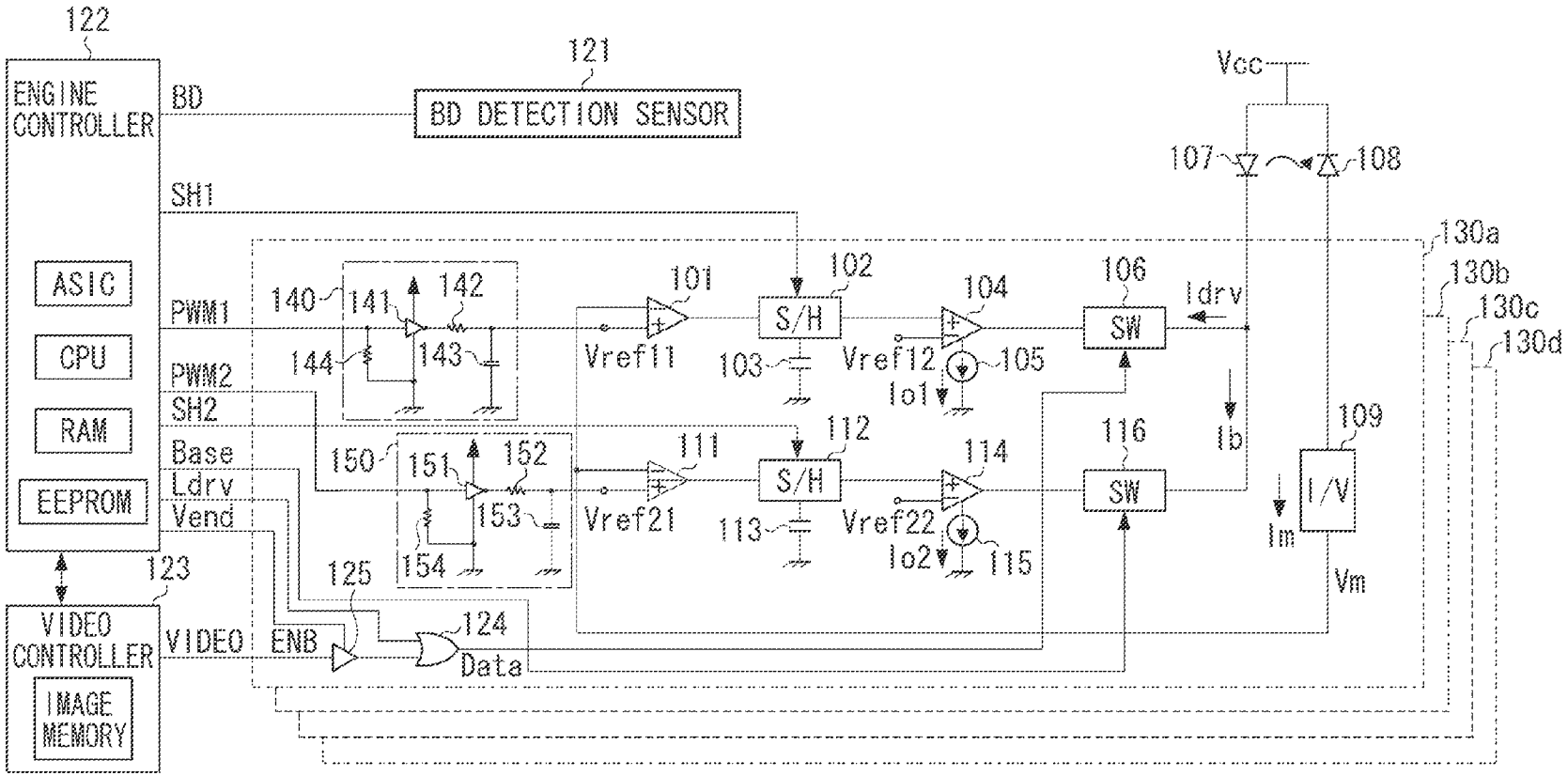
FIG. 5 illustrates an example of a laser driving circuit that has two-level light intensity adjusting function.

FIG. 5 is a laser driving system circuit that automatically adjusts the light quantity level of the LD 107 in such a way as to prevent toner particles from adhering to the photosensitive drum 1 at a non-image forming portion of the photosensitive drum 1 and to perform weak light emission without causing any normal fogging or reversal fogging. In FIG. 5, a portion surrounded with a dotted line frame 130*a* corresponds to the LD driver 130 illustrated in FIG. 4.

The laser driving system circuit illustrated in FIG. 5 includes dotted line frames 130*b* to 130*d* that are similar to the dotted line 130*a* in the internal configuration. The system configurations represented by the dotted line frames 130*a* to 130*d* correspond to a plurality of LD drivers dedicated to respective colors of the color image forming apparatus. To avoid redundant description in the following description, the configuration of the LD driver 130 of a specific color (i.e., any one of the above-mentioned four colors) is described with reference to FIG. 5.

The LD driver 130 includes PWM smoothing circuits 140 and 150 (each indicated with an alternate long and short dash line), comparator circuits 101 and 111, sample/hold circuits 102 and 112, and hold capacitors 103 and 113. Further, the LD driver 130 includes current amplification circuits 104 and 114, reference current sources (i.e., constant current circuits) 105 and 115, switching circuits 106 and 116, and a current voltage conversion circuit 109. In the following description, a photodiode 108 is referred to as PD 108.

Although described in detail below, the above-mentioned components 101 through 106 cooperatively constitute a first light intensity adjusting unit, which is functionally operable as a first current adjusting unit. The above-mentioned components 111 through 116 cooperatively constitute a second light intensity adjusting unit, which is functionally operable as a second current adjusting unit.

A light emission level (i.e., a first light emission amount) to be set for the ordinary print and a light emission level (i.e., a second light emission amount) to be set for the weak light emission are independently controllable by the first light intensity adjusting unit and the second light intensity adjusting unit, each serving as an adjusting unit configured to adjust the light emission amount.

The engine controller 122 includes an ASIC, a CPU, a random access memory (RAM), and an electrically erasable programmable read-only Memory (EEPROM). The engine controller 122 can control a printer engine and can communicate with the video controller 123.

Further, the engine controller 122 can output a PWM signal PWM1 to the PWM smoothing circuit 140. The PWM smoothing circuit 140 includes an inverter circuit 141, two resistors 142 and 144, and a capacitor 143. The inverter circuit 141 can reverse the PWM signal PWM1. The inverter circuit 141 generates an output voltage via the resistor 142 to charge the capacitor 143. The capacitor 143 generates a smoothed voltage signal. The smoothed voltage signal is then supplied, as a first reference voltage Vref11, to an input terminal of the comparator circuit 101. As mentioned above, the reference voltage Vref11 can be determined based on the pulse width of the PWM signal PWM1 and controlled by the engine controller 122.

The engine controller 122 can output a PWM signal PWM2 to the PWM smoothing circuit 150. The PWM smoothing circuit 150 includes an inverter circuit 151, two resistors 152 and 154, and a capacitor 153. The inverter circuit 151 can reverse the PWM signal PWM2. The inverter circuit 151 generates an output voltage via the resistor 152 to charge the capacitor 153. The capacitor 153 generates a smoothed voltage signal. The smoothed voltage signal is then supplied, as a second reference voltage Vref21, to an input terminal of the comparator circuit 111. As mentioned above, the reference voltage Vref21 can be determined based on the pulse width of the PWM signal PWM2 and controlled by the engine controller 122. Alternatively, directly outputting the reference voltages Vref11 and Vref21 without instructing the PWM signal from the engine controller 122 is useful.

An OR circuit 124 has an input terminal to which an Ldrv signal is supplied from the engine controller 122 and an input terminal to which a VIDEO signal is supplied from the video controller 123. The OR circuit 124 generates a Data signal that is supplied to the switching circuit 106. The VIDEO signal is a signal that is variable dependent on print data transmitted from an external device, such as an externally connected reader scanner or a host computer.

More specifically, for example, the VIDEO signal is driven based on image data of an 8-bit (=256 gradations) multi-value (0 to 255) signal and is usable to determine laser light emission time. When the image data is 0 (i.e., a background portion), the pulse width is $PW_{MIN}$ (e.g., 0.0% of 1 pixel value). When the image data is 255 (i.e., full exposure), the pulse width is $PW_{255}$ (e.g., 1 pixel value). Further, when the image data is in a range from 1 to 254, the pulse width is $PW_n$ that has a value between $PW_{MIN}$ and $PW_{255}$ and is proportional to a gradation value. The following formula (1) is usable to express the pulse width $PW_n$ that corresponds to an arbitrary gradation value in the range from 0 to 255.

$$PW_n = n \times (PW_{255} - PW_{MIN})/255 + PW_{MIN} \quad \text{formula (1)}$$

In an example, the laser diode 107 is controlled based on the image data of 8-bit (=256 gradations). As another example, a 4-bit (=16 gradations) or 2-bit (4 gradations) multi-value signal obtainable after the image data is subjected to halftone processing is usable. Further, the image data having been subjected to the halftone processing can be a binarized signal.

The VIDEO signal output from the video controller 123 is supplied to a buffer 125 that has an enable terminal (ENB). The buffer 125 generates an output that can be supplied to the OR circuit 124. In this case, the enable terminal is connected to a signal line via which a Venb signal is output from the engine controller 122.

The engine controller 122 can output an SH1 signal, an SH2 signal, a Base signal, the Ldrv signal, and the Venb signal, as described below. The Venb signal is necessary to perform mask processing on the Data signal based on the VIDEO signal. It is feasible to generate the image mask area timing (i.e., image mask period) when the Venb signal is in a disable state (i.e., in an off state).

The comparator circuit 101 has a positive terminal to which the first reference voltage Vref11 is applied. The comparator circuit 111 has a positive terminal to which the second reference voltage Vref21 is applied. The comparator circuits 101 and 111 supply their output voltages to the sample/hold circuits 102 and 112, respectively.

The first reference voltage Vref11 is a target voltage that causes the LD 107 to emit light of a light emission level suitable for the ordinary print (i.e., a first light emission level or a first light quantity). The second reference voltage Vref21 is a target voltage that causes the LD 107 to emit light of a light emission level suitable for the weak light emission (i.e., a second light emission level or a second light quantity).

The hold capacitors 103 and 113 are connected to the sample/hold circuits 102 and 112, respectively. The sample/hold circuits 102 and 112 supply their output voltages to positive terminals of the current amplification circuits 104 and 114, respectively.

The reference current sources 105 and 115 are connected to the current amplification circuits 104 and 114, respectively. The current amplification circuits 104 and 114 supply their output voltages to the switching circuits 106 and 116, respectively. The current amplification circuit 104 has a negative terminal to which a third reference voltage Vref12 is applied. The current amplification circuit 114 has a negative terminal to which a fourth reference voltage Vref22 is applied.

In the present exemplary embodiment, the difference between the output voltage of the sample/hold circuit 102 and the reference voltage Vref12 determines first drive current Io1. Further, the difference between the output voltage of the sample/hold circuit 112 and the reference voltage Vref22 determines second drive current Io2. More specifically, the reference voltages Vref12 and Vref22 cooperatively constitute a voltage setting that determines the current.

The switching circuit 106 performs ON/OFF operations based on the Data signal that is a pulse modulation data signal. The switching circuit 116 performs ON/OFF operations based on an input signal Base. The switching circuit 106 has an output terminal that is connected to a cathode of the LD 107 to supply drive current Idrv. The switching circuit 116 has an output terminal that is connected to the cathode of the LD 107 to supply drive current Ib. The LD 107 has an anode that is connected to a power source Vcc.

The photodiode 108 (hereinafter, referred to as the PD 108) can monitor the light quantity of the LD 107. The PD 108 has a cathode that is connected to the power source Vcc. Further, the PD 108 has an anode that is connected to the current voltage conversion circuit 109 to supply monitor current Im to the current voltage conversion circuit 109. The current voltage conversion circuit 109 can convert the monitor current Im into a monitor voltage Vm. The monitor voltage Vm is fed back to negative terminals of the comparator circuits 101 and 111.

In FIG. 5, the engine controller 122 and the video controller 123 are two hardware components that are mutually separated. However, it is useful to use the same controller to constitute a part or the whole of the engine controller 122 and the video controller 123. Further, a part or the whole of the LD driver 130, which is surrounded with a dotted line frame, can be incorporated in the engine controller 122.

<Description of APC of P(Idrv)>

The engine controller 122 sets the SH2 signal in such a way as to bring the sample/hold circuit 112 into a hold state (i.e., a non-sampling period) and sets the signal Base in such away as to bring the switching circuit 116 into an OFF operation state. Further, the engine controller 122 sets the SH1 signal in such a way as to bring the sample/hold circuit 102 into a sampling state. The switching circuit 106 turns on in response to the Data signal. More specifically, in this case, the engine controller 122 controls (sets) the Ldrv signal in such a way as to bring the LD 107 into a light emission state based on the Data signal. The period during which the sample/hold circuit 102 is in the sampling state corresponds to an APC operation period.

In the above-mentioned state, if the LD 107 reaches a whole light emission state, the PD 108 monitors the light emission intensity (light emission amount) of the LD 107 and causes monitor current Im1 to flow. The monitor current Im1 is proportional to the light emission intensity. When the monitor current Im1 flows into the current voltage conversion circuit 109, the current voltage conversion circuit 109 converts the monitor current Im1 into a monitor voltage Vm1. Further, the current amplification circuit 104 controls the drive current Idrv based on the current Io1 flowing through the reference current source 105 in such a way as to equalize the monitor voltage Vm1 with the first reference voltage Vref11 (i.e., the target value).

In a non-APC operation period, more specifically, in an ordinary image forming operation, the sample/hold circuit 102 is brought into a hold period (i.e., in a non-sampling period). The switching circuit 106 performs an ON/OFF operation based on the Data signal to apply pulse width modulation to the drive current Idrv.

<Description of APC of P(Ib)>

On the other hand, the engine controller 122 sets the SH1 signal in such a way as to bring the sample/hold circuit 102 into a hold state (i.e., a non-sampling period) and brings the switching circuit 106 into an OFF operation state based on the Data signal. Regarding the Data signal, the engine controller 122 brings the Venb signal terminal connected to the enable terminal of the buffer 125 into a disable state and controls the Ldrv signal to set the Data signal into an OFF state. Further, the engine controller 122 sets the SH2 signal in such away as to bring the sample/hold circuit 112 into the sampling state (i.e., the APC operation period) and sets the input signal Base in such a way as to turn on the switching circuit 116, so that the LD 107 can be brought into a weak emission state.

In the above-mentioned state, if the LD 107 reaches a whole weak emission state (i.e., alighting maintained state) in a weak light quantity state, the PD 108 monitors the light emission intensity of the LD 107 and causes monitor current Im2 (Im1>Im2) to flow. The monitor current Im2 is proportional to the monitored light emission intensity. When the monitor current Im2 flows into the current voltage conversion circuit 109, the current voltage conversion circuit 109 converts the monitor current Im2 into a monitor voltage Vm2. Further, the current amplification circuit 114 controls the drive current Ib based on the current Io2 flowing through the reference current source 115 in such a way as to equalize the monitor voltage Vm2 with the second reference voltage Vref21 (i.e., the target value).

Then, in the non-APC operation period, more specifically, in the ordinary image forming operation (i.e., in the period during which the image signal is transmitted), the sample/hold circuit 112 is brought into the hold period (i.e., in the non-sampling period). The whole weak emission state can be maintained in the weak light quantity state.

If the normal fogging/reversal fogging of the toner is ignorable, it is useful to set the laser light emission amount in the weak emission to an appropriate intensity level in such a way as to maintain the charging potential at a level equal to or higher than the developing potential, although it is not practicable. More specifically, if the normal fogging/reversal fogging of the toner is taken into consideration, it is necessary to constantly stabilize the light quantity of P(Ib) during an image forming operation.

<Description of Weak Emission Level>

Figure 6A:
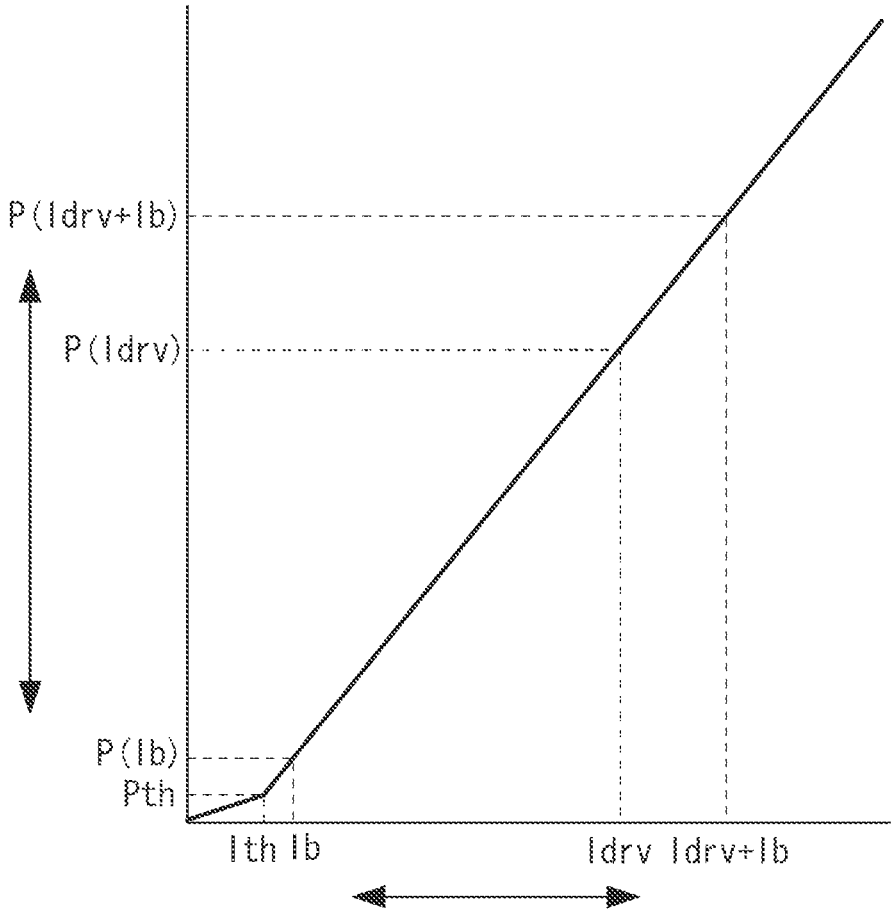
FIGS. 6A and 6B are graphs each illustrating a relationship between current that flows through a laser diode and intensity of light emitted from the laser diode.

In the above-mentioned description, the drive current Ib in the whole weak emission state is set to a level exceeding a threshold current Ith of the LD 107 illustrated in FIG. 6A and realize a weak emission level P(Ib). FIG. 6A is a graph illustrating a relationship between current value and laser light emission intensity. In the present exemplary embodiment, the weak emission level P(Ib) is a light emission level to be set for the weak light emission (i.e., the second light emission amount). If the laser irradiation is performed at the weak emission level P(Ib), no developing member (e.g., toner) can adhere to a charged photosensitive drum. Namely, no image can be formed on the photosensitive drum. In this respect, the toner fogging state can be maintained adequately at the weak emission level P(Ib).

More specifically, the light emission level P(Ib) dedicated to the weak light emission is a light emission amount (W) (i.e., the quantity of light emission per unit time) of the LD 107 that is required to form the post weak-exposure charging potential Vd_bg by exposing a non-image forming portion on the surface of the photosensitive drum 1 by the exposure amount Ebg ($\mu J/cm^2$).

Further, it is now assumed that the light emission intensity at the light emission level P(Ib) is a light emission intensity of laser light to be emitted from the LD 107. If the light emission intensity at the light emission level P(Ib) is insufficient for causing the LED to emit laser light, the spectral wavelength distribution greatly spreads and the wavelength distribution becomes wider compared to the rated wavelength of the laser. Therefore, the sensitivity of the photosensitive drum is disturbed and the surface potential becomes unstable. Accordingly, the light emission intensity at the light emission level P(Ib) is required to be sufficient for the LD 107 to perform laser light emission.

On the other hand, in the ordinary image forming operation, the light emission level setting is performed in such away that the drive current Idrv+Ib can realize the intensity of print level P(Idrv+Ib). The print level P(Idrv+Ib) is a print dedicated light emission level (i.e., the first light emission amount), at which the amount of the developing member adhering to the charged photosensitive drum can be saturated. More specifically, the print level P (Idrv+Ib) is a light emission amount (W) of the LD 107 that is required to form the exposure potential Vl by exposing an image forming portion on the surface of the photosensitive drum 1 by the exposure amount E ($\mu J/cm^2$).

The charging voltage Vcdc described with reference to FIGS. 3A and 3B is set to be variable depending on environmental conditions or operating conditions (e.g., deterioration) of the photosensitive drum. From the viewpoint of adequately maintaining the image quality, the light quantity (i.e., the intensity at the second light emission level) required for the target light emission level to be set for the weak emission P(Ib) is required to be variable depending on the above-mentioned conditions. For example, when the Vcdd value becomes larger, the light quantity at the weak emission level Ebg becomes larger. On the other hand, when the Vcdc value becomes smaller, the light quantity at the weak emission level Ebg becomes smaller, as is described in detail below.

<Description of P(Ib+Idrv) Light Emission>

Then, the circuit illustrated in FIG. 5 can be operated in the following manner to cause the LD 107 to emit light of a light emission level to be set for the ordinary print. More specifically, the engine controller 122 sets the sample/hold circuit 112 to the hold period to cause the switching circuit 116 to perform an ON operation. Further, the engine controller 122 sets the sample/hold circuit 102 to the hold period to cause the switching circuit 106 to perform an ON operation. Thus, the drive current Idrv+Ib can be supplied. Further, when the switching circuit 106 is in an OFF state, the weak emission level P(Ib) can be realized by the drive current Ib.

Although described in detail below, the print level P(Idrv+Ib) becomes equivalent to a superimposition of the weak emission level P(Ib) and a PWM light emission level P(Idrv) by the pulse width modulation. More specifically, when both the SH2 and SH1 signals are set to the hold period and the Base signal is set to ON, and further when the engine controller 122 sets the Venb signal to an enable state, the switching circuit 106 performs the ON/OFF operation based on the Data signal (the VIDEO signal). Thus, two-level light emission becomes feasible in a drive current range from Ib to Idrv+Ib, more specifically in a light emission intensity range from P(Ib) to P(Idrv+Ib) (see an arrow in FIG. 6A). Further, the P(Ib)-based laser light emission can be performed for the time corresponding to a pulse duty at the light quantity of P(Idrv+Ib).

When the circuit illustrated in FIG. 5 operates in the above-mentioned manner, the engine controller 122 performs APC for causing the LD 107 to emit light at the weak emission level P(Ib). Further, the video controller 123 outputs the VIDEO signal to cause the LD 107 to emit light at the print level P(Idrv+Ib), i.e., the first level, based on the Data signal, in a laser light emission area. In other words, the circuit illustrated in FIG. 5 can realize two-level light emission.

<Another Laser Driving System Circuit>

Figure 6B:
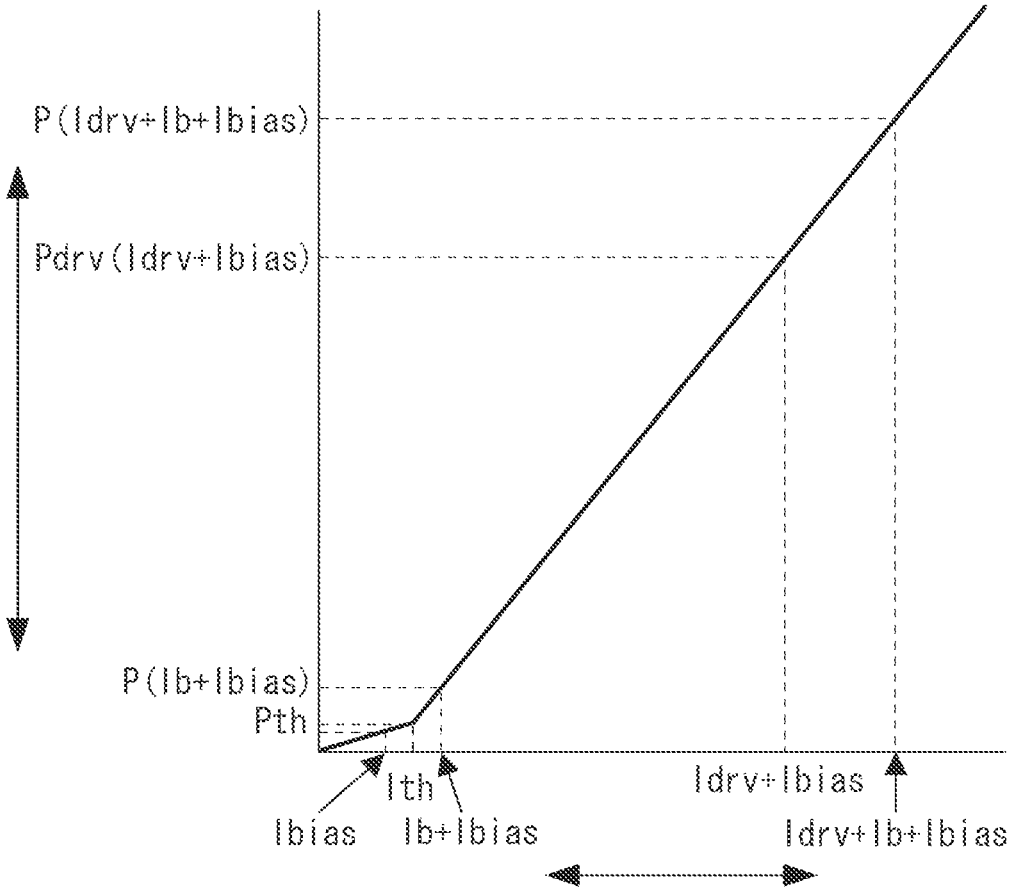
Figure 7:
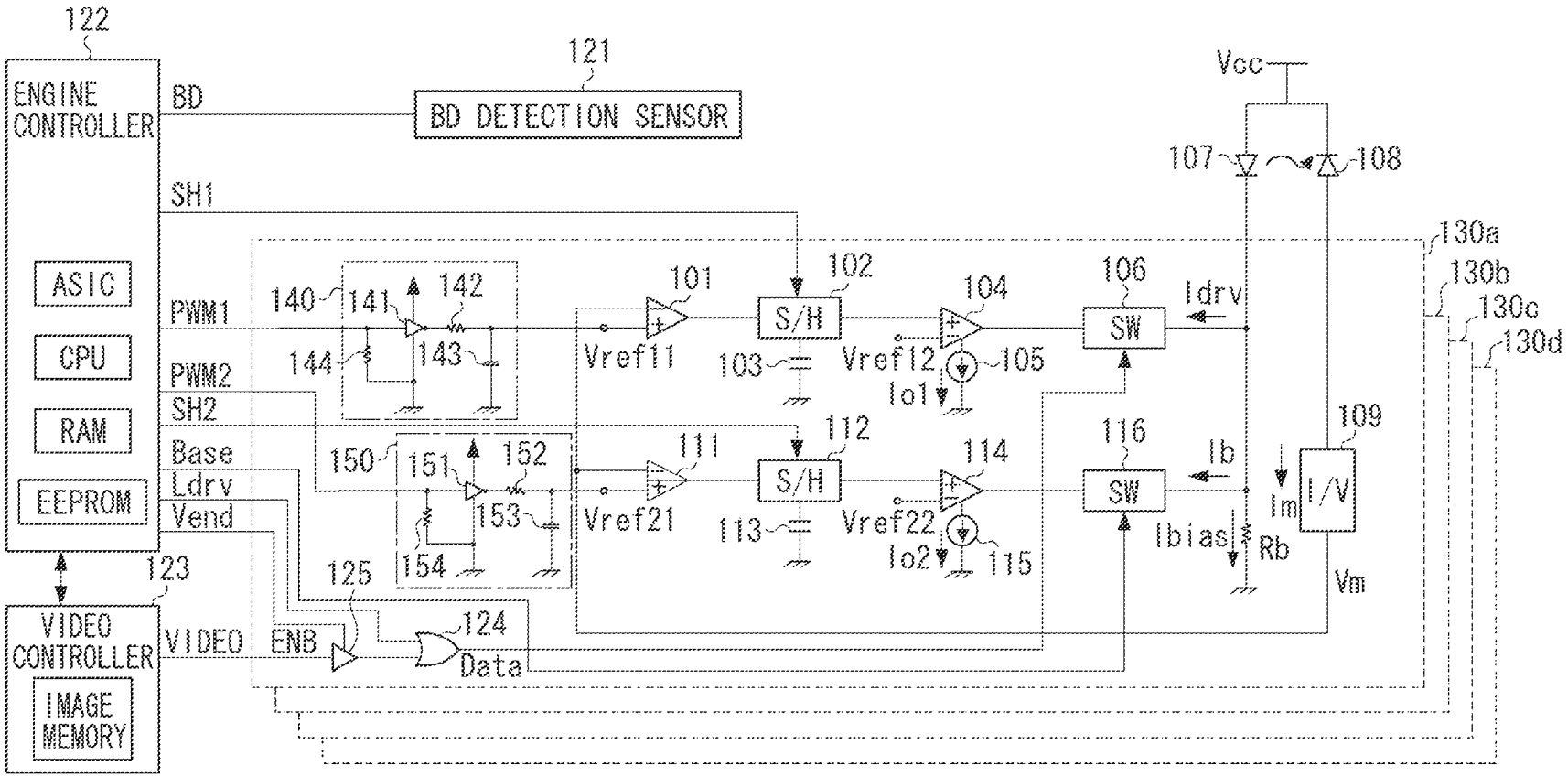
FIG. 7 illustrates another example of the laser driving circuit that has the two-level light intensity adjusting function.

A circuit illustrated in FIG. 7 is different from the circuit illustrated in FIG. 5 in that a resistor Rb is added to cause bias current Ibias to flow. The bias current Ibias is set to be smaller than the threshold current Ith of the LD 107. The bias current Ibias is set in an ordinary LED light emission area, which is a range other than the laser light emission area. FIG. 6B illustrates a relationship between current value and laser light emission intensity. The bias current brings an effect of improving the start-up characteristics of the LD 107 as discussed in various literatures.

In the circuit illustrated in FIG. 7, when the SH2 signal brings the sample/hold circuit 112 into a hold state and the switching circuit 116 performs an ON operation, drive current (Ib+Ibias) is supplied to the LD 107. According to the circuit illustrated in FIG. 7, in this case, the LD 107 performs light emission at weak emission level light emission intensity P(Ib+Ibias). The light emission level P(Ib+Ibias) is the laser light emission area. Further, the SH1 signal sets the sample/hold circuit 102 to a hold period. The Data signal causes the switching circuit 106 to perform an ON operation so that the drive current Idrv can be further supplied. Thus, summed-up drive current (Idrv+Ib+Ibias) can be supplied. The laser driving system can perform light emission of a light emission level P(Idrv+Ib+Ibias) to be set for the ordinary print.

As mentioned above, the LD 107 performs light emission in response to the ON/OFF operation of the switching circuit 106 in such a way as to switch the light emission at the light emission intensity of print level P(Idrv+Ib+Ibias) and the weak emission level P(Ib+Ibias) of the drive current (Ib+Ibias).

More specifically, in a state where both the SH2 and SH1 signals are set to the hold period and the Base signal is set to ON, the engine controller 122 sets the Venb signal to the enable state to cause the switching circuit 106 to perform an ON/OFF operation in response to the Data signal, which is based on the VIDEO signal. Thus, two-level light emission becomes feasible for PWM laser light emission in a drive current range from (Ib+Ibias) to (Idrv+Ib+Ibias), more specifically in a light emission intensity range from P(Ib+Ibias) to P(Idrv+Ib+Ibias) (see an arrow in FIG. 6B).

<Two-Level APC Sequence>

Figure 8:
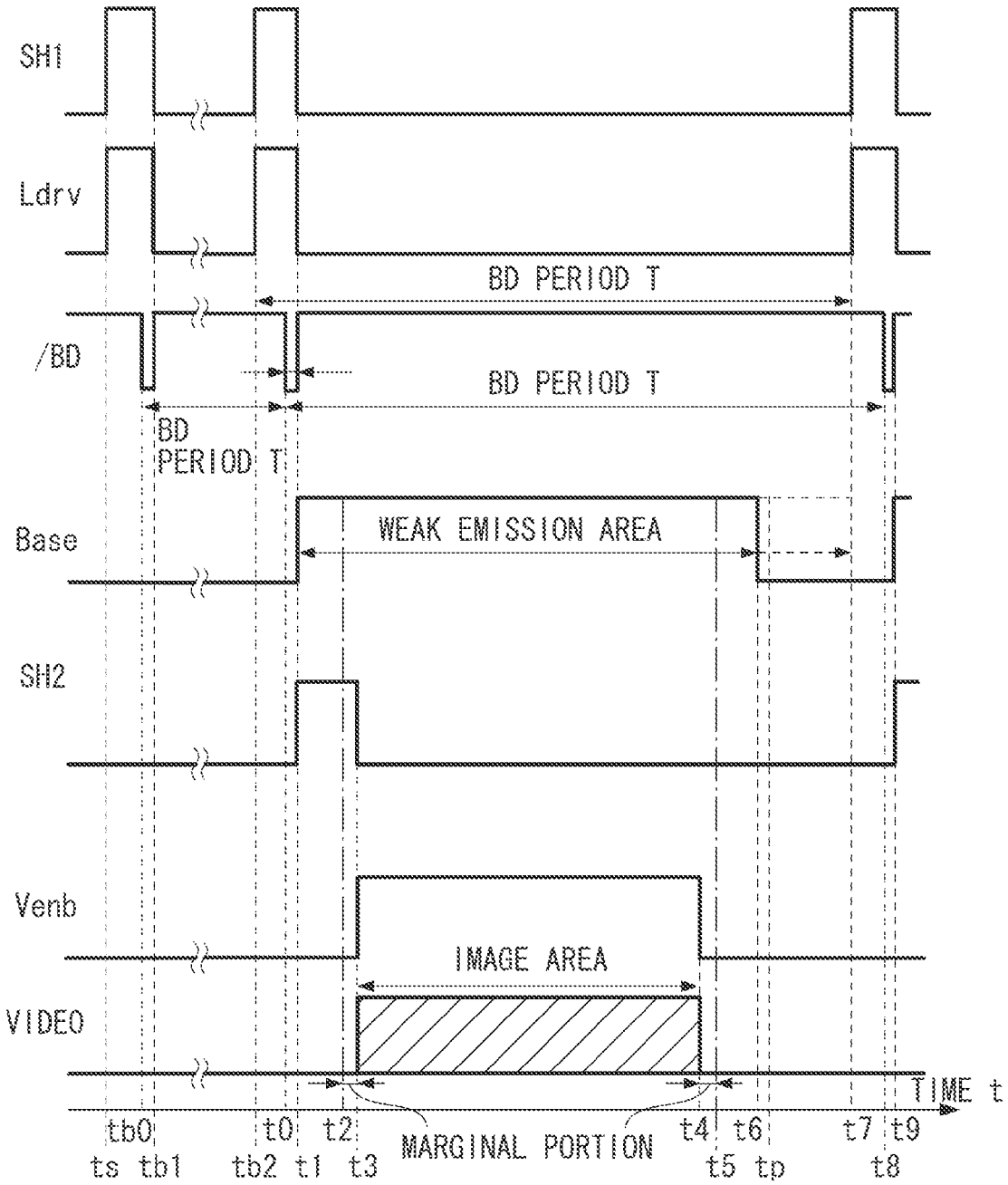
FIG. 8 is a timing diagram illustrating an automatic light quantity control.

Next, execution timings of various APC processing capable of maintaining the laser light emission level are described below. FIG. 8 is a timing diagram illustrating an example of the laser scanning operation. First, at timing ts, the engine controller 122 sets the SH1 signal and the Ldrv signal to ON and turns on the switching circuit 106. In the following description, "timing ts" is simply referred to as "ts." Then, the output of the BD detection sensor 121 is output as a horizontal synchronization signal /BD at timing tb0. If the engine controller 122 detects the horizontal synchronization signal /BD at the timing tb0, the engine controller 122 turns the SH1 signal and the Ldrv signal to OFF at timing tb1 and turns off the switching circuit 106. Thus, the engine controller 122 terminates the ordinary print level APC. After the termination of the print level APC, the LD 107 performs laser light emission of an ordinary print level according to the VIDEO signal. Then, the laser light emission based on the VIDEO signal continues in the duration from tb1 to tb2, although redundant description thereof will be avoided.

Next, the engine controller 122 performs Io1 (first drive current) adjusting processing with reference the output timing (i.e., detection timing) of the horizontal synchronization signal /BD that corresponds to the previous scanning line. More specifically, the engine controller 122 sets the SH1 signal and the Ldrv signal to ON and turns on the switching circuit 106 at timing tb2 (before detection of the next horizontal synchronization signal /BD), namely after a predetermined time has elapsed since the output timing (tb0 or tb1) of the horizontal synchronization signal /BD. Thus, the engine controller 122 restarts the print level APC.

Further, in starting the above-mentioned APC, the engine controller 122 sets the Venb signal to OFF to input a disable instruction to the enable terminal of the buffer 125. It is assumed that the disable instruction has been similarly supplied to the buffer 125 in the immediately preceding APC. Then, even when the video controller 123 outputs an erroneous (e.g., noise) signal, an APC-related control instruction output from the engine controller 122 can be reflected in the control.

Then, an output signal of the BD detection sensor 121 is generated as the horizontal synchronization signal /BD at timing t0. If the engine controller 122 detects the horizontal synchronization signal /BD at the timing t0, then at timing t1, the engine controller 122 sets the SH1 signal and the Ldrv signal to OFF and turns off the switching circuit 106 to terminate the print level APC again.

Subsequently, the engine controller 122 sets the SH2 signal and the Base signal to ON and turns on the switching circuit 116 at timing t1 (namely after the detection of the horizontal synchronization signal /BD). Thus, the engine controller 122 starts a weak emission level APC at timing t1. Alternatively, the engine controller 122 can start the weak emission level APC at any time after the timing t1 and before timing t2. The duration from t1 to t2 is the image mask period. In short, it is useful that the engine controller 122 starts the weak emission level APC within the image mask period.

In particular, it is useful to perform the weak emission level APC in a marginal portion period from t2 to t3, during which the engine controller 122 maintains the SH2 signal in an ON state. In other words, the engine controller 122 continues the weak emission level APC until the timing t3. Thus, it becomes feasible to perform the weak emission level APC for a longer time. In this case, the paper edge timing is t2 and a relationship t1<t2<t3 is satisfied.

Figure 9A:
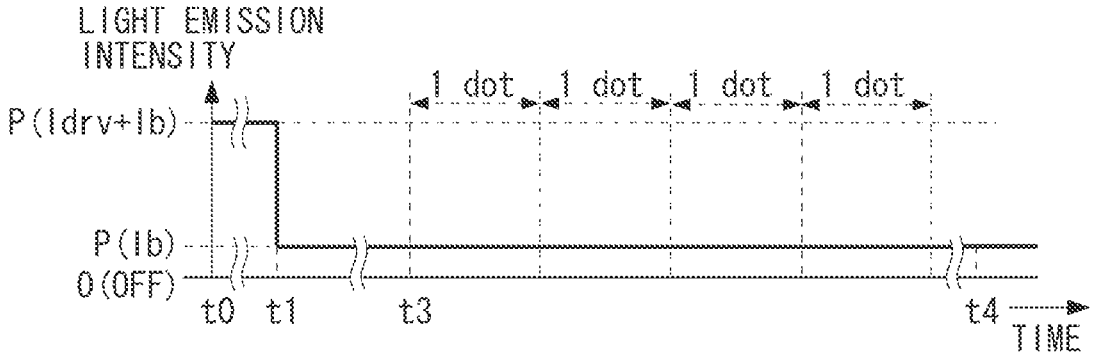
FIGS. 9A, 9B, and 9C are timing diagrams each illustrating a relationship between weak emission and PWM light emission.
Figure 9B:
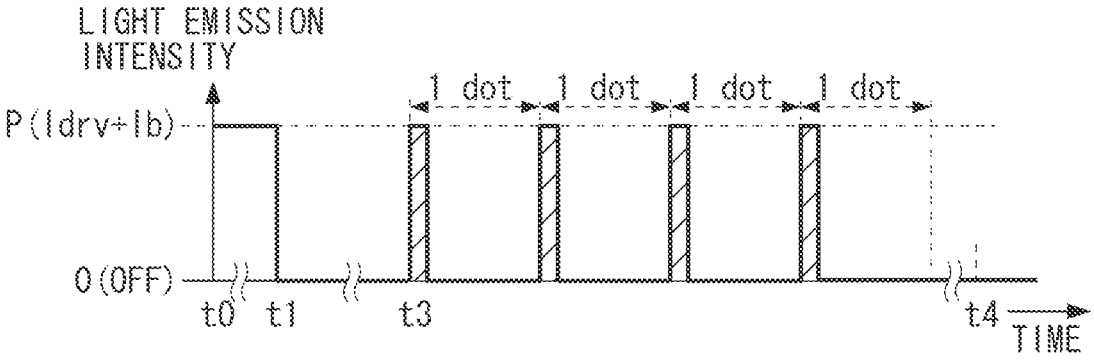

FIG. 9A illustrates an example transition in the light emission intensity of the LD 107 in the above-mentioned case. Further, FIG. 9B illustrates an example transition in the light emission intensity of the LD 107 in a PWM-based weak light emission. In the PWM-based weak light emission illustrated in FIG. 9B, the LD 107 performs light emission of the print level P(Idrv+Ib) for each pixel (i.e., one dot) in a non-image forming portion at a predetermined rate (more specifically, at a minute pulse width corresponding to weak emission intensity) in synchronization with an imaging clock (having a fixed frequency). In FIG. 9B, the light quantity of the weak emission level (i.e., a hatching portion) can be realized as mentioned above. On the other hand, in the present exemplary embodiment, the LD 107 continuously emits the light at the constant weak emission level P(Ib) in such a way as to realize the light emission intensity of the weak emission level.

As mentioned above, the laser driving system performs an automatic laser light intensity adjusting operation in a non-image region, such as an intervening region between two scanning lines (namely, outside a valid area of the photosensitive drum). However, if the image forming apparatus or the optical scanning device is greatly downsized, the ratio of a one-scanning image region increases and the time ratio of a non-image region decreases.

Even in such a case, according to the time chart illustrated in FIG. 8, the laser driving system performs the automatic light intensity adjusting operation, which is to be executed when the SH2 signal is valid, after the horizontal synchronization signal /BD is output. Therefore, even when the laser scanning approaches a marginal portion of a paper, the system can continue the light intensity adjusting operation.

Referring back to FIG. 8, the engine controller 122 sets the Venb signal to ON to input an enable instruction to the enable terminal of the buffer 125 at timing t3, namely after a predetermined time has elapsed since the output timing (t0 or t1) of the horizontal synchronization signal /BD. Thus, the image mask is cancelled. Further, in response to the enable instruction input to the enable terminal, the video controller 123 outputs the VIDEO signal at timing t3, namely after a predetermined time has elapsed since the output timing (t0 or t1) of the horizontal synchronization signal /BD.

Then, the LD 107 emits laser light of the print light emission level P(Ib+Idrv). The optical scanning device described with reference to FIG. 4 performs a laser scanning operation. In this case, as understood from FIG. 8, the weak light emission region (t1 to t6) in which the light emission is performed at the light emission intensity of the weak emission level has an area larger than the maximum image region (t3 to t4) to be scanned based on the VIDEO signal. The laser driving system causes the LD 107 to perform the weak light emission operation in an area larger than an area between two paper edge timings. Further, the LD 107 performs the weak light emission operation at a non-image forming portion in the area of the VIDEO signal.

Figure 9C:
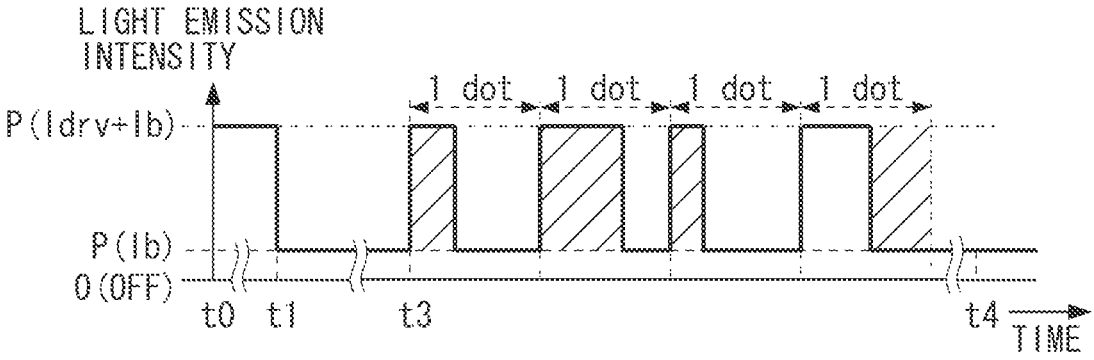

FIG. 9C illustrates a state of light emission from the LD 107 when the video controller 123 outputs the VIDEO signal. The PWM-based weak light emission is a sum of the light emission at the light emission intensity of the weak emission level (light emission time) within one pixel described in FIG. 9B and the light emission of the same print level P(Idrv+Ib). On the other hand, in the present exemplary embodiment, as illustrated in FIG. 9C, the PWM light emission caused by the pulse width modulation is superimposed on the constant light emission of the weak emission level P(Ib) (see FIG. 9A). According to the time chart illustrated in FIG. 9C, it is feasible to suppress radiation noises that may occur when the LD 107 performs the weak light emission operation, compared to the case where the PWM weak light emission is performed as illustrated in FIG. 9B.

Referring back to the description of the timing diagram illustrated in FIG. 8, the video controller 123 performs laser light dot scanning on an image forming area of the photosensitive drum according to the VIDEO signal until timing t4, namely after a predetermined time has elapsed since the output timing (t0 or t1) of the horizontal synchronization signal /BD.

The section from t3 to t4 corresponds to a light emission section in which the LD 107 emits laser light to a toner image forming area (i.e., an electrostatic latent image forming area). The engine controller 122 sets the Venb signal to OFF to input a disable instruction to the enable terminal of the buffer 125 at timing t4, namely after a predetermined time has elapsed since the output timing (t0 or t1) of the horizontal synchronization signal /BD. Thus, the image mask cancellation period terminates. In other words, the remaining section corresponds to the image mask period.

Further, the engine controller 122 sets the Base signal to OFF to turn off the switching circuit 116 at timing t6, namely after a predetermined time has elapsed since the output timing (t0 or t1) of the horizontal synchronization signal /BD. Thus, the laser driving system terminates the weak light emission.

In this case, the paper edge timing is t5 and a relationship t4<t5<t6 is satisfied. In the present exemplary embodiment, at the paper edge timing, an edge of a peripheral side that is parallel to a recording paper conveyance direction just reaches a laser light emitting position of the intermediate transfer belt where the LD 107 emits laser light.

According to the example illustrated in FIG. 8, the termination timing of the weak light emission (see timing t6) is earlier than polygon edge timing tp (i.e., a transition timing from one surface to another surface of the polygonal mirror 133). However, the LD 107 can continuously perform the weak light emission operation until timing t7 (as indicated by a dotted line in the drawing).

As mentioned above, the laser driving system can perform the automatic light intensity adjustment at the weak emission level in the region from t1 to t6, which is wider than the image region (from t3 to t4) and is wider than the paper edge-to-edge region (from t2 to t5).

Further, when the time exceeds t7, namely after a predetermined time has elapsed since the output timing (t0 or t1) of the horizontal synchronization signal /BD, the engine controller 122 repetitively performs processing similar to the processing having been performed from the timing tb2. Thus, when the laser driving system executes a print job in response to an externally input print request, the laser driving system can effectively perform various APC operations a plurality of times. The frequency at which the laser driving system performs APC operations can be determined for each laser scanning, or for each page (only for the first scanning performed on the page), or for every predetermined number of (two or more) laser scanning operations.

Further, the APC operation is performed a plurality of times in each job. Therefore, the laser driving system can adjust the weak emission light quantity a plurality of times during the execution of one job. The laser driving system can appropriately maintain the charging potential Vd during the execution of one job. As a result, the laser driving system can suppress reversal fogging and normal fogging appropriately. Although the timing diagram illustrated in FIG. 8 has been described based on P(Ib) and P(Idrv+Ib), if P(Ib) and P(Idrv+Ib) are replaced by P(Ib+Ibias) and P(Idrv+Ib+Ibias) respectively, similar effects can be obtained using the circuit illustrated in FIG. 7.

The above-mentioned APC described with reference to FIG. 8 includes the APC of P(Idrv) and the APC of P(Ib). It is also useful to prioritize the execution of the APC of P(Ib) and subsequently perform APC of P(Ib+Idrv). More specifically, the laser driving system performs the APC of P(Ib) first. Then, the engine controller 122 sets the SH2 signal in such a way as to bring the sample/hold circuit 112 into a hold period and sets the input signal Base in such a way as to bring the switching circuit 116 into an ON state.

More specifically, the engine controller 122 brings the LD 107 into a bias light emission (i.e., laser light emission area) state. At the same time, the engine controller 122 sets the sample/hold circuit 102 into a sampling state and brings the switching circuit 106 into an ON state based on the Data signal, similar to the above-mentioned exemplary embodiment, so that the LD 107 can perform whole light emission.

When the LD 107 reaches the whole light emission state, the PD 108 monitors the light emission intensity of the LD 107. Further, monitor current Im1' proportional to the actual light emission intensity flows into the current voltage conversion circuit 109. The current voltage conversion circuit 109 converts the monitor current Im1' into monitor voltage Vm1'. The current amplification circuit 104 controls drive current Idrv' based on current Io1' flowing through the reference current source 105 in such a way as to equalize the monitor voltage Vm1' with first reference voltage Vref11' (i.e., target value). In this case, the reference voltage Vref11' has a voltage value that corresponds to P(Ib+Idrv). Further, the drive current Idrv' is equivalent to a difference between the current required for light emission of P(Ib+Idrv) light quantity and the current required for light emission of P(Ib) light quantity.

Further, for example, it is useful to perform the APC of P(Ib+Idrv) according to the timing of the APC of P(Idrv) illustrated in FIG. 8. Further, although it is necessary to perform the APC of P(Ib) in advance before starting the APC of P(Ib+Idrv), a method for performing the APC of P(Ib) before the forcible light emission to be performed to detect the horizontal synchronization signal /BD is available. Although the operation has been described based on P(Ib) and P(Idrv+Ib), if P(Ib) and P(Idrv+Ib) are replaced by P(Ib+Ibias) and P(Idrv+Ib+Ibias) respectively, similar effects can be obtained using the circuit illustrated in FIG. 7.

Although the above-mentioned APC described with reference to FIG. 8 includes the APC of P(Idrv) and the APC of P(Ib), the APC is not limited to the above-mentioned example. For example, it is useful to perform the APC of P(Ib+Idrv) instead of performing the APC of P(Ib). More specifically, after completing the APC of P(Idrv), the engine controller 122 sets the SH1 signal in such a way as to bring the sample/hold circuit 102 into the hold period (i.e., the non-sampling period) to cause the switching circuit 106 to operate in an ON state. Further, simultaneously, the engine controller 122 sets the SH2 signal in such a way as to bring the sample/hold circuit 112 into the APC operation period and sets the input signal Base in such a way as to bring the switching circuit 116 into an ON state.

When the LD 107 reaches the whole light emission state, the PD 108 monitors the light emission intensity of the LD 107. Then, monitor current Im2' (Im1<Im2') proportional to the actual light emission intensity flows into the current voltage conversion circuit 109. The current voltage conversion circuit 109 converts monitor current Im2' into monitor voltage Vm2'. The current amplification circuit 114 controls drive current Ib based on current Io2' flowing through the reference current source 115 in such a way as to equalize the monitor voltage Vm2' with reference voltage Vref21', which is a sum of the first reference voltage and the second reference voltage (i.e., the target value).

Then, the engine controller 122 sets the SH2 signal to OFF to bring the sample/hold circuit 112 into a hold state, so that the capacitor 113 can be charged to have a potential level corresponding to the drive current Ib. Then, in the non-APC operation period, the sample/hold circuit 112 is brought into the hold period (i.e., the non-sampling period). When the Base signal is ON, the LD 107 performs whole light emission with light quantity that corresponds to the drive current Ib.

In the above-mentioned description, the laser diode 107 performs exposure (i.e., light emission) processing, as an example of a preferred embodiment. For example, as another exemplary embodiment, it is useful to employ a system including an LED array as the exposure unit, in which the VIDEO signal is input to a driver that drives each LED light emitting element and the above-mentioned processing is performed.

The image forming apparatus according to the present exemplary embodiment has the above-mentioned configuration. In the following description, an operation of each exposure device (i.e., a light irradiation unit) that performs weak light emission at a portion where no toner image is to be visualized is described below with reference to FIGS. 11 to 13, based on the configuration illustrated in FIGS. 1 to 9. Further, an operation of each exposure device that performs ordinary light emission at a portion where a toner image is to be visualized, based on the light quantity for image forming data in addition to the light quantity for the weak light emission, is described.

Further, in an exemplary embodiment described below, target levels of the light emission intensity P(Ib) dedicated to the weak light emission and the ordinary exposure intensity P(Idrv+Ib) are changeable according to the life span of the photosensitive drum. A system configuration of and operations to be performed by the exposure device 31*a* in the first image forming station "a" are described in detail below, although the exposure devices 31*b* to 31*d* of the second to fourth image forming stations have similar configuration and perform similar operations.

<Necessity of Correcting Weak Light Emission Intensity>

First, a problem that may occur due to a difference in processing speed is described below with reference to FIG. 10A. Even when the light emission amount of the laser diode 107 is fixed, if the processing speed is not stable, the exposure amount per unit area of the photosensitive drum 1 is variable correspondingly. In the above-mentioned state, as illustrated in FIGS. 3A and 3B, if the common high-voltage power source applies the constant charging voltage Vcdc to a plurality of photosensitive drums to cause the laser diode 107 to emit a fixed quantity of light, the exposure amount per unit area of the photosensitive drum 1 is variable. More specifically, if the processing speed is low, the exposure amount becomes larger. If the processing speed is high, the exposure amount becomes smaller.

Figure 10A:
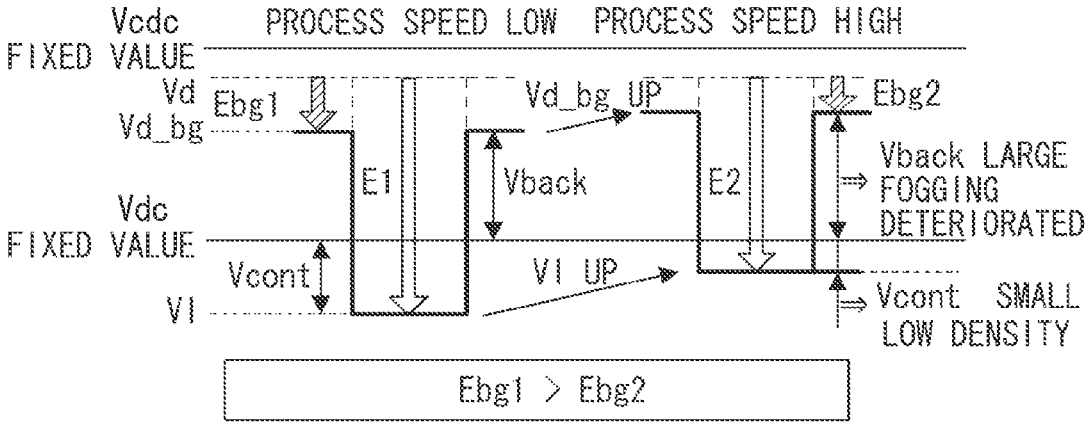
FIGS. 10A, 10B, and 10C illustrate a relationship between charging potential, developing potential, and exposure potential in each processing speed.

Then, for example, as understood from FIG. 10A, the following problems occur if the setting of the light emission intensity of the laser diode 107 is performed to realize an exposure amount Ebg1 dedicated to the weak exposure and an exposure amount E1 dedicated to the ordinary exposure, in a low processing speed mode, in such a way as to set a back contrast Vback (=Vd_bg−Vdc), which is a contrast between the developing potential Vdc and a corrected charging potential Vd_bg, to be a desired state.

More specifically, in a high processing speed mode, an exposure amount Ebg2 dedicated to the weak exposure becomes smaller. Therefore, the absolute value of the corrected charging potential Vd_bg becomes larger (Vd_bg Up) and the back contrast Vback becomes larger. If the back contrast Vback becomes larger, fogging occurs because toner particles that could not be charged to have a regular polarity (e.g., toner particles charged to have zero or positive polarity (i.e., not negative polarity) when the reversal development is performed as described in the present exemplary embodiment) are transferred from the developing roller to a non-image forming portion.

Further, as the corrected charging potential Vd_bg increases and an exposure amount E2 for the ordinary exposure becomes smaller, the exposure potential Vl (VL) increases (Vl Up). Therefore, a developing contrast Vcont (=Vdc−Vl), which is a difference between the developing potential Vdc and the exposure potential Vl (VL), becomes smaller. In this case, toner particles cannot be electrostatically transferred sufficiently from the developing roller to the photosensitive drum. A solid black image having a low density easily occurs.

Figure 10B:
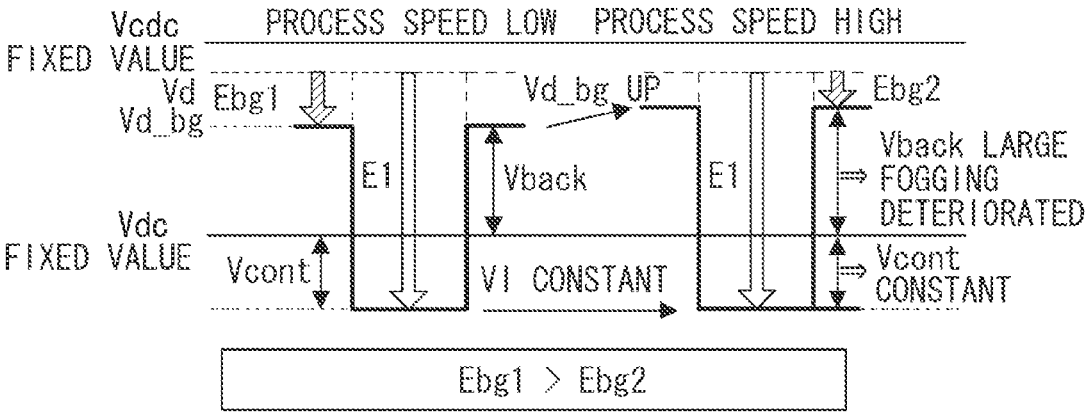

On the other hand, as illustrated in FIG. 10B, if the exposure intensity changes from E2 to E1 (>E2) while the developing potential Vdc and the charging voltage Vcdc are fixed, the developing contrast Vcont (i.e., the difference between the developing potential Vdc and the exposure potential Vl (VL)) can be controlled to be a substantially constant value by the ordinary exposure amount control. Accordingly, the density can be maintained at a constant level. However, the back contrast Vback (i.e., the contrast between the developing potential Vdc and the charging potential Vd) is widened. Thus, the above-mentioned problem (i.e., generation of fogging) remains unsolved.

Further, in general, the film thickness of the photosensitive drum surface becomes thinner when the usage time of the photosensitive drum 1 increases. If there is a plurality of photosensitive drums that are mutually different in operating conditions (e.g., in the cumulative number of rotations), the film thicknesses of respective photosensitive drums are not the same. In the above-mentioned state, if the common high-voltage power source illustrated in FIGS. 3A and 3B applies the constant charging voltage Vcdc to the plurality of photosensitive drums, in general, a potential difference caused in an air gap between the charging roller 2 and the photosensitive drum 1 is not the same. The charging potential Vd of the photosensitive drum surface is variable.

More specifically, if the number of image forming operations is smaller, the photosensitive drum has a larger film thickness. The absolute value of the charging potential Vd of the photosensitive drum surface becomes smaller. On the other hand, if the cumulative number of rotations is large, the photosensitive drum has a smaller film thickness. The absolute value of the charging potential Vd of the photosensitive drum surface becomes larger.

Then, the following problems occur if the common high-voltage power source illustrated in FIGS. 3A and 3B controls the developing potential Vdc and the charging potential Vd in such a way as to set the back contrast Vback (=Vd_bg−Vdc) (i.e., the contrast between the developing potential Vdc and the corrected charging potential Vd_bg) to be a desired value, for example, in the photosensitive drum having a larger film thickness.

More specifically, in an image forming station that includes a photosensitive drum whose film thickness is smaller, the absolute value of the charging potential Vd becomes larger and the back contrast Vback becomes larger.

Further, in an image forming station that includes a photosensitive drum whose film thickness is smaller, the charging potential Vd increases. Therefore, if the exposure intensity is constant, the exposure potential Vl (VL) increases (Vl Up). Therefore, the developing contrast Vcont (=Vdc−Vl) becomes smaller.

On the other hand, if the exposure intensity is changed in such a way as to set the exposure potential Vl (VL) of each image forming station to be constant while the developing potential Vdc and the charging voltage Vcdc are fixed, the developing contrast Vcont of each image forming station can be controlled to be substantially a constant value. However, even in this case, the above-mentioned problem (i.e., the back contrast Vback is widened) remains unsolved.

<Correction of Light Emission Intensity in Weak Light Emission>

To the contrary, in the present exemplary embodiment, for example, even in a case where the power source configuration illustrated in FIGS. 3A and 3B is employed, a simple configuration is usable to control the charging potential and suppress generation of fogging or generation of low-density portion. Hereinafter, an example of light intensity correction processing is described below with reference to a flowchart illustrated in FIG. 11.

The following correction processing includes changing a weak exposure amount $E_0$ of respective laser diodes 107*a* to 107*d* in relation to the processing speed and the remaining life span of respective photosensitive drums 1*a* to 1*d* in a non-toner adhering background portion (i.e., in a non-image forming portion). More specifically, the correction processing is performed in such a way as to change the target voltage Vref21 of the light emission level to be set for the weak light emission, in relation to the processing speed and the remaining life span of respective photosensitive drums 1*a* to 1*d*.

First, in step S101, the engine controller 122 reads processing speed information from the RAM provided in the engine controller 122. The processing speed information includes information required to determine the present processing speed. The processing speed information can be direct information or indirect information. For example, the processing speed information is a speed ratio relative to an ordinary processing speed. Alternatively, the processing speed information can be indirect information, such as a print mode instructed from the video controller 123 or a detection result obtained by a sensor (not illustrated) that detects the type (e.g., surface roughness or thickness) of a recording material.

In step S102, the engine controller 122 reads the cumulative number of rotations of the photosensitive drum 1, as information relating to the remaining life span of the photosensitive drum 1, from the storage member of each image forming station. The storage member provided in respective image forming stations "a" to "d" is the memory tag (not illustrated). Alternatively, an appropriate RAM provided in the engine controller 122 can be used as a storage member if it stores necessary information.

More specifically, information relating to operating conditions, such as the cumulative number of rotations or usage history of the photosensitive drum 1, can be regarded as the information relating to the remaining life span of the photosensitive drum 1. Further, information relating to the photosensitive characteristics of the photosensitive drum 1 (EV curve characteristics) described with reference to FIG. 2 can be also regarded as the information relating to the remaining life span of the photosensitive drum 1.

Further, information relating to the film thickness of the photosensitive drum is another example of the information relating to the remaining life span of the photosensitive drum, because the film thickness correlates with the cumulative number of rotations of the photosensitive drum. For example, the number of rotations of the intermediate transfer belt, the number of rotations of the charging roller, and the number of printed papers (in which the paper size is taken into consideration) are the information relating to the film thickness of the photosensitive drum.

Further, it is useful to provide a detection unit configured to directly measure the film thickness of the photosensitive drum 1 in association with each photosensitive drum 1. In this case, the obtained detection result can be regarded as the information relating to the remaining life span of each photosensitive drum 1. Further, charging current flowing through the charging roller 2, driving time of a motor that drives the photosensitive drum 1, and driving time of a motor that drives the charging roller 2 can be regarded as the information relating to the remaining life span of the photosensitive drum 1.

In step S103, the engine controller 122 refers to a table illustrated in FIG. 12 that determines a correspondence relationship between cumulative number of rotations of the photosensitive drum 1 (photosensitive drum operating conditions) and ordinary exposure related parameters. Further, in the same step, the engine controller 122 refers to a table illustrated in FIG. 13 that determines a correspondence relationship between processing speed ratio of the photosensitive drum 1 and ordinary exposure (i.e., exposure in ordinary operation) related parameters.

In the table illustrated in FIG. 13, the technical term "thinning-out" means a surface skipping control applied to the polygonal mirror 133. For example, when the numerical value of the "thinning-out" is m, the engine controller 122 performs the following control after an electrostatic latent image has been formed with laser light having reached one of "n" reflection surfaces (n is an integer equal to or greater than 3) of the polygonal mirror 133.

More specifically, if a surface of the polygonal mirror 133 is irradiated with the laser light, the subsequent consecutive m surfaces (n>m, and m is an integer equal to or greater than 1) are not irradiated with the laser light. Then, the (m+1)th surface is irradiated with the laser light. In other words, when the numerical value of the "thinning-out" is m, the polygonal mirror 133 can be irradiated with the laser light at intervals of (m+1) surfaces.

Further, the information acquired in step S102 is variable depending on each photosensitive drum. Therefore, the engine controller 122 refers to the table illustrated in FIG. 12 having been set for each photosensitive drum. On the other hand, the information acquired in step S101 is the same for each photosensitive drum.

Then, the engine controller 122 sets an ordinary exposure amount parameter for respective laser diodes 107*a* to 107*d* based on the processing speed information acquired in step S101 and the cumulative number of rotations acquired in step S102. The above-mentioned exposure parameter corresponds to the reference voltage Vref11 illustrated in FIGS. 5 and 7. A detailed parameter setting method is described below.

Through the processing to be performed in step S103, the engine controller 122 acquires laser light emission setting required to set the exposure potential Vl (VL) of each photosensitive drum 1 to a target potential or any potential in a permissible range, regardless of sensitivity characteristics (EV curve characteristics) of each photosensitive drum 1. Then, the engine controller 122 causes the laser diodes 107*a* to 107*d* to perform ordinary light emission based on the acquired setting, to at least suppress unstableness of a post-exposure potential Vl (VL) after the ordinary exposure in each of a plurality of photosensitive drums 1. Thus, a desired potential can be realized.

The target exposure potential is basically the same or substantially the same for respective photosensitive drums 1. However, if desirable, the target exposure potential of each photosensitive drum 1 can be independently set according to characteristics of each photosensitive drum 1. Further, when the technical term "exposure" is used, it means that the exposure is performed on the photosensitive drum. In other words, a light emission device for the exposure of the photosensitive drum is present. Accordingly, when the technical term "exposure" is used with respect to a parameter, the parameter relates to "light emission."

The operation to be performed by the engine controller 122 in step S103 is further described in detail below. First, the engine controller 122 sets the light emission luminance value (mW) that corresponds to the processing speed information and the acquired cumulative information of each photosensitive drum 1 to be Vref11*a* to Vref11*d* according to the PWM signal instruction.

To simplify the description, the table illustrated in FIG. 12 includes the light emission luminance value (mW). However, in practice, the engine controller 122 sets the voltage value/signal, which corresponds to the light emission luminance value, to be Vref11*a* to Vref11*d* according to the PWM signal instruction. Further, the engine controller 122 sets the PWM value of the ordinary exposure (density 0%) to $PW_{MIN}$ and sets the PWM value of the ordinary exposure (density 100%) to $PW_{255}$ (see FIG. 12). Then, the engine controller 122 sets a pulse width that corresponds to image data of an arbitrary gradation value n(=0 to 255) using the following formula (1).

$$PW_n = n \times (PW_{255} - PW_{MIN})/255 + PW_{MIN} \quad \text{formula (1)}$$

According to the formula (1), $PW_n = PW_{MIN}$ if n=0 and $PW_n = PW_{255}$ if n=255. Then, the engine controller 122 instructs a voltage value/signal that is equivalent to the pulse width ($PW_n$) that corresponds to the above-mentioned setting, as a VIDEO signal "a", when light emission based on image data of an arbitrary gradation value "n" is externally instructed.

Further, the engine controller 122 performs similar processing for VIDEO signals "b" to "d." Further, the formula (1) is based on an 8-bit multi-value signal. However, as mentioned above, the engine controller 122 can perform processing in the following manner if the signal is any other arbitrary m-bit (e.g., 4-bit, 2-bit, or 1-bit (binary)) signal. More specifically, the pulse width $PW_{MIN}$ is allocated to image data 0 and pulse width $PW_{255}$ is allocated to gradation value $(2^m-1)$.

Subsequently, in step S104, the engine controller 122 sets the reference voltage Vref21 as a parameter relating to the laser light emission intensity $E_0$ for the weak exposure (i.e., light emission luminance (mW) in FIG. 12) based on processing speed information and cumulative number of rotations. Even in step S104, the engine controller 122 refers to the tables illustrated in FIGS. 12 and 13 for each photosensitive drum. More specifically, the engine controller 122 reads the processing speed information acquired in step S101 and the Vref21 value (PWM value) that corresponds to the cumulative information acquired in step S102, for each photosensitive drum, and sets reference voltages Vref21*a* to Vref21*d* based on the read information. An example method for setting parameters dedicated to the weak light exposure is described in detail below.

Through the processing to be performed in step S104, the engine controller 122 can acquire a setting required to set the charging potential Vd of each photosensitive drum 1 to a target potential (i.e., a value of the corrected charging potential Vd_bg) or any potential in a permissible range, regardless of the photosensitive drum sensitivity characteristics (EV curve characteristics).

Then, the LD driver 130 performs APC according to the acquired setting to cause the laser diodes 107*a* to 107*d* to perform weak light emission in such a way as to prevent the corrected charging potential from varying at a background portion (i.e., a non-image forming portion) in each of a plurality of photosensitive drums 1. The target exposure potential (which corresponds to the Vref11 value) of each photosensitive drum is basically/substantially the same.

However, the target exposure potential of each photosensitive drum 1 can be independently set according to the characteristics of each photosensitive drum 1. When the processing in steps S103 and S104 is performed as mentioned above, it becomes feasible to appropriately set the exposure amount for a non-image forming portion and an image forming portion of the photosensitive drum 1 by appropriately setting the light emission amount for the weak exposure (weak light emission) and for the ordinary exposure (ordinary light emission) considering the processing speed and the remaining life span of each photosensitive drum.

In steps S103 and S104, the engine controller 122 has been described to refer to the tables illustrated in FIGS. 12 and 13. However, the operation of the engine controller 122 is not limited to the above-mentioned example. For example, it is useful that the CPU of the engine controller 122 is configured to perform a calculation using a formula. More specifically, it is useful that the CPU performs calculations to obtain desired setting values (e.g., Vref11*a* to Vref11*d* and Vref21*a* to Vref21*d*) based on the processing speed information and the parameter indicating the remaining life span of the photosensitive drum 1 (e.g., the cumulative number of rotations of the photosensitive drum 1).

Further, it is useful to prepare a table that stores all values calculated using the formula (1) beforehand, so that the engine controller 122 can refer to the prepared table. Further, it is useful to use a memory tag (not illustrated) that stores a plurality of EV curves (see FIG. 2), which corresponds to various operating conditions of the photosensitive drum 1. In this case, the engine controller 122 identifies an optimum EV curve according to information relating to the acquired operating conditions of the photosensitive drum 1.

Further, the engine controller 122 calculates a necessary exposure amount ($\mu J/cm^2$) based on the identified EV curve and a desired photosensitive drum potential. Then, the engine controller 122 calculates a light emission luminance, a weak exposure pulse width, and an ordinary exposure pulse width, based on each obtained exposure amount ($\mu J/cm^2$). The engine controller 122 sets the calculation results as parameters that correspond to steps S103 and S104.

Referring back to the description of FIG. 11, in step S105, the engine controller 122 controls (or instructs) each member to execute sequential image forming operations and controls described with reference to FIG. 1. Further, in step S106, the engine controller 122 measures the number of rotations for each of the photosensitive drums "a" to "d" that have rotated in the sequential image forming operations. The engine controller 122 performs the above-mentioned measuring processing to update the operating conditions of the photosensitive drum 1. Further, in practice, the engine controller 122 performs the processing in step S106 in parallel to the processing in step S105.

In step S107, the engine controller 122 determines whether the image forming operation has been completed. If it is determined that the image forming operation has been completed (Yes in step S107), the operation proceeds to step S108. In step S108, the engine controller 122 adds a measurement result of each photosensitive drum 1 measured in step S106 to a corresponding cumulative number of rotations.

In step S109, the engine controller 122 stores the updated cumulative number of rotations in a nonvolatile memory tag (not illustrated) of each image forming station. Through the above-mentioned processing in step S109, the information relating to the remaining life span of the photosensitive drum 1 can be updated. The storage destination can be any type of storage unit other than the above-mentioned memory tag (not illustrated) as described in step S102.

<Description of Correction Table Illustrated in FIG. 12>

Figure 11:
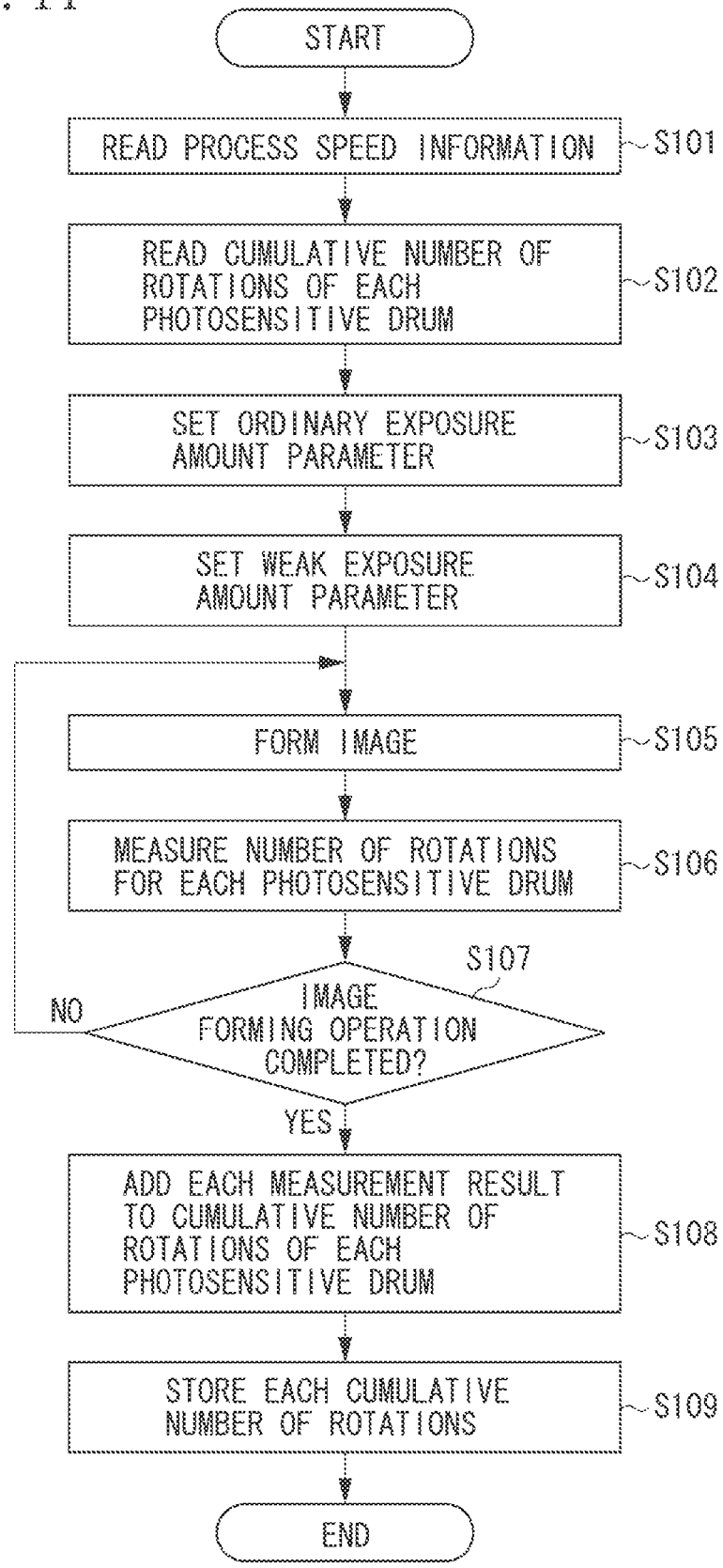
FIG. 11 is a flowchart illustrating processing for setting ordinary exposure parameters and weak exposure parameters in each processing speed and processing for updating image forming processing and photosensitive drum operating conditions.

FIG. 12 illustrates a detailed example of the table that the engine controller 122 can refer to in steps S103 and S104 illustrated in FIG. 11. The table illustrated in FIG. 12 includes light emission control settings for the weak light emission and for the ordinary light emission in association with information relating to the remaining life span of the photosensitive drum 1 (e.g., the number of drum rotations that indicates the cumulative number of rotations).

In the drawings, the exposure amount ($\mu J/cm^2$) dedicated to the weak exposure and the exposure amount ($\mu J/cm^2$) dedicated to the ordinary exposure are set beforehand based on the photosensitive characteristics (see EV curve illustrated in FIG. 2) of the target photosensitive drum 1. The table illustrated in FIG. 12 includes reference voltage Vref21 values and corresponding PWM values, as settings corresponding to the light emission luminance (light emission amount) (mW) dedicated to the weak exposure.

Further, the table illustrated in FIG. 12 includes reference voltage Vref11 values and corresponding PWM values, as settings corresponding to an additional light emission luminance (mW) for causing the laser diode 107 to emit light in the ordinary exposure. The above-mentioned reference voltage Vref11 setting is necessary to realize the additional light emission luminance (mW) in FIGS. 5 and 7 and corresponds to the additional light emission luminance illustrated in FIG. 12. Then, the engine controller 122 can refer to the table illustrated in FIG. 12 to eliminate or reduce a variance in surface potential of a background portion in each of the plurality of charged photosensitive drums. Further, the engine controller 122 can refer to the table illustrated in FIG. 12 to eliminate or reduce a variance in the post-exposure potential Vl (VL) in each of the plurality of photosensitive drums subjected to the ordinary exposure.

In the table illustrated in FIG. 12, the light emission luminance (mW) is variable depending on the number of rotations of the drum in both of the weak exposure and the ordinary exposure. Therefore, the engine controller 122 can appropriately perform settings not only for the weak exposure but also for the ordinary exposure in accordance with the cumulative number of rotations of the photosensitive drum 1, with reference to the table illustrated in FIG. 12.

In the table illustrated in FIG. 12, both the weak exposure amount and the ordinary exposure amount increase linearly in accordance with the cumulative number of rotations of the photosensitive drum 1. However, the table is not limited to the above-mentioned example. For example, it is useful to prepare a table that stores exposure amount data increasing nonlinearly according to the cumulative number of rotations of the photosensitive drum 1, when the characteristics of the photosensitive drum 1 are taken into consideration.

<Description of Correction Table Illustrated in FIG. 13>

FIG. 13 illustrates a detailed example of the table that the engine controller 122 can refer to in steps S103 and S104 illustrated in FIG. 11. The table illustrated in FIG. 13 includes processing speed and thinning-out settings of the photosensitive drum 1 in association with light emission luminance ratio in the weak light emission or in the ordinary light emission. The light emission luminance ratio is a value indicating a setting ratio of a light emission luminance relative to the light emission luminance corresponding to the processing speed ratio 1/1 (more specifically, light emission luminance determined using the table illustrated in FIG. 12). The table illustrated in FIG. 13 can be stored in an appropriate storage unit that the engine controller 122 can access. For example, the table illustrated in FIG. 13 can be stored in an electrically erasable programmable read-only memory (EEPROM) provided in the engine controller 122.

In the table illustrated in FIG. 13, if the thinning-out setting value is zero (e.g., when the processing speed ratio is 4/5), the light emission luminance ratio to be set is equal to the processing speed ratio itself. For example, in a case where the polygonal mirror 133 has only four surfaces, it is unfeasible to perform a face skipping control to realize the setting of processing speed ratio 4/5. More specifically, in this case, the rotational speed of the polygonal mirror 133 is reduced to a 4/5 level, instead of performing the face skipping control.

On the other hand, if the thinning-out setting value is not zero, the number of thinning-out operations is taken into consideration in addition to the processing speed ratio in the setting of the light emission luminance in such away as to hold the total exposure amount per unit area of the photosensitive drum 1 at the same value. More specifically, the following formula is usable to express the light emission luminance ratio.

$$\text{Light emission luminance ratio} = \text{processing speed ratio} \times (\text{number of thinning-out operations} + 1) \quad \text{formula (2)}$$

For example, if the processing speed ratio is 1/2 and the thinning-out setting value is 1, the light emission luminance ratio to be set is equal to 1 (=(1/2)×(1+1)). More specifically, it is unnecessary to change the light emission luminance of the laser diode itself. Further, if the processing speed ratio is 3/5, the light emission luminance ratio to be set is equal to 1.2 (=(3/5)×(1+1)=6/5). More specifically, when the processing speed is 3/5, the light emission luminance of the laser diode 107 is set to be a greater value compared to a case that the processing speed is 1/1, considering the execution of the face skipping control.

For example, there is a method for reducing the light emission luminance ratio to 3/5 without performing the face skipping control. However, such a method includes the following demerits. If the light emission luminance decreases, the adjustment of the light quantity for the weak light emission is performed in a light emission intensity region equal to or less than Pth in FIGS. 6A and 6B.

First, in an ordinary light emitting operation, the accuracy of the light emission intensity deteriorates because of the following reason. As understood from FIGS. 6A and 6B, the gradient of a line defining the relationship between the light emission intensity and the current flowing through the laser diode 107 changes at the point Pth. When the light emission intensity is equal to or less than Pth, the gradient of the line is smaller. On the other hand, when the light emission intensity exceeds Pth, the gradient of the line is larger.

In the light emission intensity region equal to or less than Pth, a variation in the diode current relative to a variation in the light emission intensity during an APC for the weak light emission is larger compared to a case where the light emission intensity is equal to or greater than Pth. Therefore, if a constant current control is performed to drive the laser diode 107 with the current (Idrv+Ib) in the image area, a larger variation occurs in the current flowing through the laser diode 107 (Idrv+Ib). The accuracy of the light emission intensity P(Idrv+Ib) in an ordinary light emitting operation deteriorates. This is the reason why setting a target light emission luminance less than Pth for the weak exposure is not desired when the processing speed ratio is greatly reduced.

In setting the processing speed ratio to be a value less than that for the ordinary operation (less than 1), it is effective to set the light emission luminance ratio to be greater than 1 and set the rotational speed of the rotating polygonal mirror to be greater than that for the ordinary operation, and further combine the face skipping control. In the present exemplary embodiment, the ordinary operation corresponds to an image forming operation to be performed using a plain paper without decreasing the ordinary processing speed (i.e., at the highest processing speed).

<Detailed Description of Steps S103 and S104>

The tables illustrated in FIGS. 12 and 13 have the following relevancy. For example, when the cumulative number of rotations of the photosensitive drum 1 is 80,000 and the processing speed ratio is 1/2, the light emission luminance L11 for the ordinary exposure can be calculated in the following manner. Numerical values 4.09 (mW) and 1.0 in the following formula can be determined by the engine controller 122 with reference to the tables illustrated in FIGS. 12 and 13. Further, the light emission luminance L12 can be calculated in the same manner.

$$L11 = 4.09\ (\text{mW}) \times 1.0 = 4.09\ (\text{mW})$$

The engine controller 122 sets a Vref11 value (1.07V) that corresponds to the calculated light emission luminance 4.09 (mW) with the PWM duty (28.4%). The setting of the reference voltage Vref11 is necessary to realize the additional light emission luminance (mW) in FIGS. 5 and 7.

Further, for example, when the cumulative number of rotations of the photosensitive drum 1 is 80,000 and the processing speed ratio is set to 1/2 for the weak exposure, the light emission luminance L12 can be calculated in the following manner.

$$L12 = 0.95\ (\text{mW}) \times 1.0 = 0.95\ (\text{mW})$$

Then, the engine controller 122 sets a Vref21 value (0.71V) that corresponds to the calculated light emission luminance 0.95 (mW) with the PWM duty (52.8%).

As mentioned above, the engine controller 122 refers to the tables illustrated in FIGS. 12 and 13 to eliminate or reduce a variance in the surface potential at a background portion in each of a plurality of charged photosensitive drums. Further, the engine controller 122 refers to the tables illustrated in FIGS. 12 and 13 to eliminate or reduce a variance in the post-exposure potential Vl (VL) in each of the plurality of photosensitive drums subjected to the ordinary exposure.

In the table illustrated in FIG. 12, both the weak exposure amount and the ordinary exposure amount increase linearly in accordance with the cumulative number of rotations of the photosensitive drum 1. However, the table is not limited to the above-mentioned example. For example, it is useful to prepare a table that store exposure amount data increasing non-linearly according to the cumulative number of rotations of the photosensitive drum 1, when the characteristics of the photosensitive drum 1 are taken into consideration.

<Description of Functions and Effects>

Figure 10C:
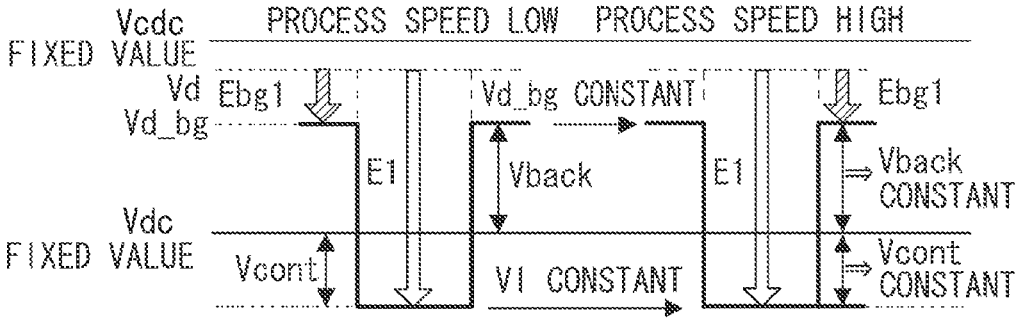

Even when the processing speed is changed, the laser driving system according to the present exemplary embodiment can prevent the reversal fogging from deteriorating by holding the charging potential (i.e., background potential) at a constant level. To this end, the laser driving system changes the light emission luminance for the weak exposure in such a way as to hold the exposure amount Ebg1 dedicated to the weak exposure at a constant level as illustrated in FIG. 10C.

Further, in addition to the above-mentioned effect, the laser driving system according to the present exemplary embodiment can form the background potential without causing any deterioration in uniformity of the charging potential (that may be caused by a dirty charging roller). Accordingly, the laser driving system according to the present exemplary embodiment can effectively suppress the increase in the background potential and the deterioration in uniformity when the processing speed changes. Further, as the background potential is held at a constant level in each image forming station, the laser driving system according to the present exemplary embodiment can prevent the fogging from deteriorating even when the voltage is applied from the same power source to each developing roller.

A second exemplary embodiment is described below. In the first exemplary embodiment, the table illustrated in FIG. 12 stores weak exposure parameters and ordinary exposure parameters that correspond to photosensitive drum operating conditions. Further, the table illustrated in FIG. 13 stores light emission luminance ratios that correspond to respective processing speed ratios. Further, the engine controller 122 controls the charging potential of each photosensitive drum appropriately with reference to the tables illustrated in FIGS. 12 and 13 in such away as to realize various processing speeds, with a simplified configuration. However, the tables to be referred to in obtaining similar effects are not limited to the above-mentioned examples illustrated in FIGS. 12 and 13. A modified embodiment with respect to the tables to be referred to is described below with reference to FIGS. 14 and 15.

A table illustrated in FIG. 14 includes ordinary exposure parameters and weak exposure parameters that are usable when the cumulative number of rotations of the photosensitive drum is equal to or greater than $1.5\times10^5$. Further, the setting of the ordinary exposure parameters and the weak exposure parameters in the table illustrated in FIG. 14 is performed for each processing speed ratio in such a way as to set the maximum light emission luminance (mW) when the processing speed ratio is 3/5.

On the other hand, a table illustrated in FIG. 15 includes light emission luminance ratios preferable for the weak exposure and light emission luminance ratios (additional light emission luminance) preferable for the ordinary exposure in association with various photosensitive drum operating conditions. The light emission luminance ratios in the table illustrated in FIG. 15 are usable when the cumulative number of rotations of the photosensitive drum is equal to or greater than $1.5\times10^5$. The light emission luminance is set to be a smaller value in each cumulative number of rotations of the photosensitive drum.

The engine controller 122 performs calculations with reference to the tables illustrated in FIGS. 14 and 15 in the following manner.

For example, when the processing speed ratio is 1/2 and the cumulative number of rotations of the photosensitive drum 1 is 80,000, the light emission luminance L11 for the ordinary exposure can be calculated in the following manner. Numerical values 4.76 and 0.86 in the following formula can be determined by the engine controller 122 with reference to the tables illustrated in FIGS. 14 and 15.

$$L11=4.76\ (\text{mW})\times0.86\approx4.09\ (\text{mW})$$

The engine controller 122 sets a Vref11 value that corresponds to the calculated light emission luminance, in the same manner as described above with reference to FIGS. 12 and 13.

Further, for example, when the processing speed ratio is 1/2 and the cumulative number of rotations of the photosensitive drum 1 is 80,000, the light emission luminance L12 for the weak exposure can be calculated in the following manner.

$$L12=1.68\ (\text{mW})\times0.57\approx0.96\ (\text{mW})$$

The engine controller 122 sets a Vref21 value that corresponds to the calculated light emission luminance, in the same manner as described above with reference to FIGS. 12 and 13. As mentioned above, it is feasible to obtain a result similar to that described in the first exemplary embodiment even when the engine controller 122 refers to the tables different from those illustrated in FIGS. 12 and 13.

In the above-mentioned first and second exemplary embodiments, the LD 107 serving as a light emitting element (i.e., a light source) includes only one light emitting unit. In the present exemplary embodiment, the LD 107 includes two light emitting units 107*a* and 107*b* that cooperatively constitute a multi-beam configuration, as described below. In the first and second exemplary embodiments, the engine controller 122 changes the light emission luminance to change the light emission amount (i.e., the quantity of light emitted by the light emitting element per unit time).

To the contrary, in a third exemplary embodiment, the engine controller 122 deactivates a part of the plurality of light emitting units to change the light emission amount. In the following description, only a unique arrangement according to the present exemplary embodiment is described in detail. The rest of the configuration is similar to that described in the first exemplary embodiment, although redundant description thereof will be avoided.

Figure 16:
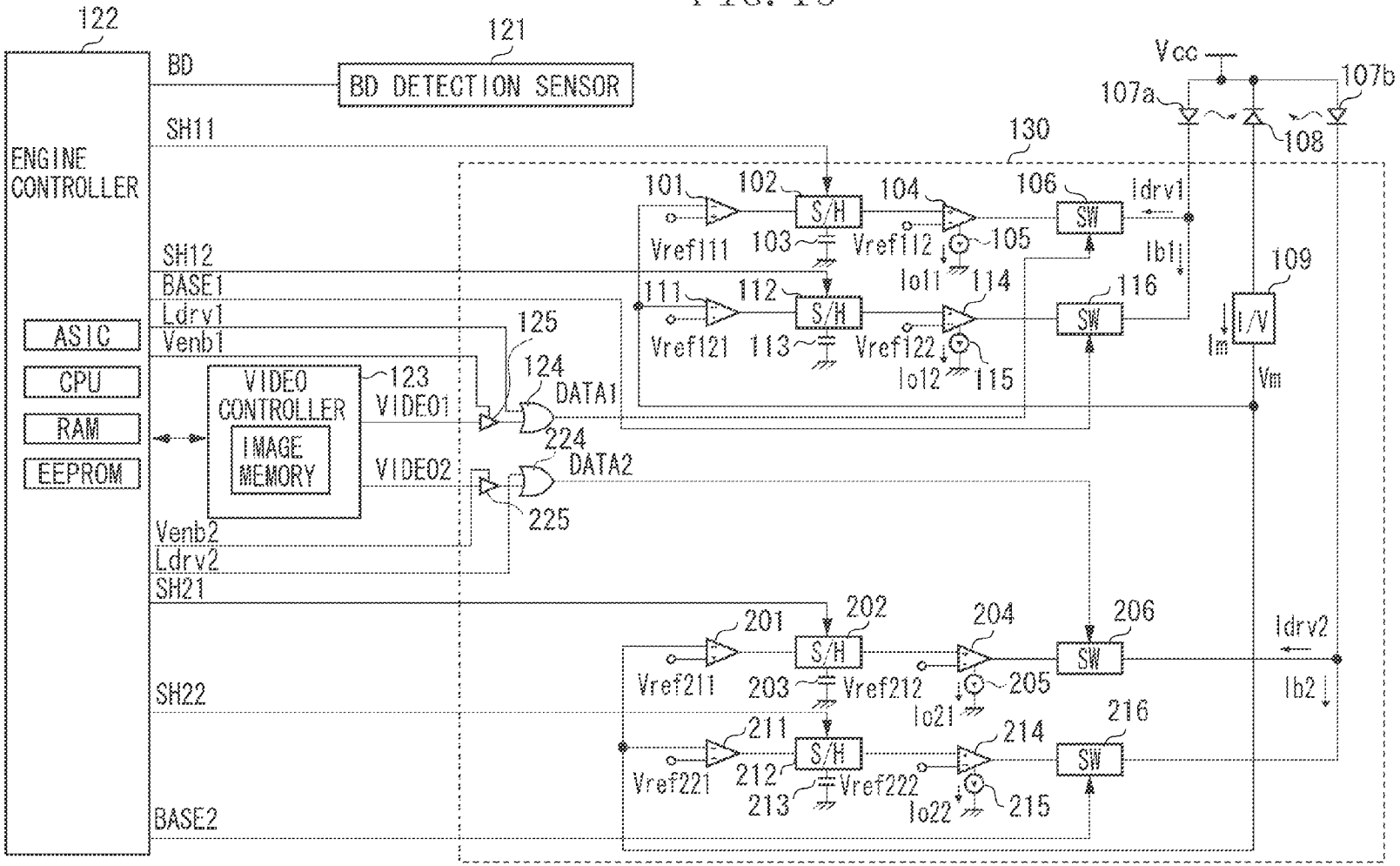
FIG. 16 illustrates an example of the laser driving circuit that includes two-light emitting units capable of realizing the two-level light intensity adjusting function.

FIG. 16 illustrates a laser driving system circuit. The laser driving system circuit according to the present exemplary embodiment includes an LD driver 130 that is provided for each of the light emitting units 107*a* and 107*b*. The LD driver 130 illustrated in FIG. 16 is basically similar to the portion surrounded with the dotted line 130*a* in FIG. 5, although a part of the circuit components is omitted.

The laser driving system circuit illustrated in FIG. 16 includes a PD 108 and a current voltage conversion circuit 109 that are commonly provided for respective light emitting units 107*a* and 107*b*. Two comparator circuits 201 and 211 are similar to the comparator circuits 101 and 111 illustrated in FIG. 5. Further, two sample/hold circuits 202 and 212, two hold capacitors 203 and 213, two current amplification circuits 204 and 214, two reference current sources (i.e., constant current circuits) 205 and 215, and two switching circuits 206 and 216 are similar to those illustrated in FIG. 5.

Accordingly, the light emitting units 107*a* and 107*b* of the LD driver 130 are similar to the LD 130*a* illustrated in FIG. 5 in their operations. More specifically, the engine controller 122 drives the light emitting unit 107*a* with the drive current Ib1 or Idrv1+Ib1. The engine controller 122 drives the light emitting unit 107*b* with the drive current Ib2 or Idrv2+Ib2. The light emitting unit 107*a* performs light emission at the print level P(Idrv1+Ib1) and at the weak emission level P(Ib1). Further, the light emitting unit 107*b* performs light emission at the print level P(Idrv2+Ib2) and at the weak emission level P(Ib2). Further, the engine controller 122 performs APC of P(Idrv1) or P(Idrv2) and APC of P(Ib1) or P(Ib2) similarly.

In the present exemplary embodiment, in steps S103 and S104 of the flowchart illustrating in FIG. 11, the engine controller 122 refers to the table illustrated in FIG. 12 and further refers to a table illustrated in FIG. 17 that determines a correspondence relationship between the processing speed ratio of the photosensitive drum 1 and exposure related parameters. The engine controller 122 sets reference voltages Vref121 and Vref221 as parameters relating to laser light emission intensity $E_0$ for the weak exposure (i.e., light emission luminance (mW) in FIG. 12) based on processing speed information and cumulative number of rotations.

In FIG. 17, the technical term "scanning line thinning-out" indicates that a part of the scanning lines that are alternately formed by the light emitting units 107*a* and 107*b* is thinned out. More specifically, for example, when the processing speed ratio is 1/1, the scanning line thinning-out value is 0. In this case, the light emitted from each of the light emitting units 107*a* and 107*b* is reflected by one surface of the polygonal mirror 133 in such a way as to simultaneously form two scanning lines.

On the other hand, for example, when the processing speed ratio is 1/2, the scanning line thinning-out value is 1. In this case, one of the light emitting units 107*a* and 107*b* is deactivated and the light emitted from the remaining light emitting unit is reflected by one surface of the polygonal mirror 133 in such a way as to form a single scanning line.

As mentioned above, the laser driving system according to the present exemplary embodiment performs scanning line thinning-out processing by deactivating one of two light emitting units 107*a* and 107*b*, instead of thinning out a surface of the polygonal mirror 133. Therefore, the laser driving system can change the light emission amount dedicated to the weak light emission (i.e., the second light emission amount) for the entire LD 107 (i.e., alight source whose emission amount is equivalent to a sum of the light emission amounts of two light emitting units 107*a* and 107*b*). As mentioned above, the laser driving system according to the present exemplary embodiment brings effects similar to those described in the first and second exemplary embodiments.

<Modified Embodiment>

In the above-mentioned first to third exemplary embodiments, a single power source (which corresponds to the transformer 53) is commonly used as a common high-voltage power source for the charging rollers 2 and the developing rollers 43 in both of FIGS. 3A and 3B. However, as apparent from the description with reference to FIG. 10, it is also feasible when a charging power control cannot be independently performed for respective colors. It is also feasible when a developing power control cannot be independently performed for respective colors.

Accordingly, it is useful to provide a single power source for a plurality of chargings (corresponding to a single transformer) and a single power source for a plurality of developings (corresponding to a single transformer). Each of single power sources is distinguished by describing them as a first single power source and a second single power source. In this case, the voltage to be output from the single power source for charging (a first power source voltage), or a voltage converted by converters (a first converted voltage), is supplied to the corresponding charging rollers 2*a* to 2*d*. Further, the voltage to be output from the single power source for developing (a second power source voltage), or a voltage converted by converters (a second converted voltage), is supplied to the corresponding developing roller 43*a* to 43*d*. Further, as described in FIGS. 3A and 3B, the voltages to be input to respective rollers (i.e., the charging rollers and the developing rollers) can be modified in various ways.

For example, it is useful to directly input the power source voltages (i.e., the first power source voltage and the second power source voltage) of each of single power sources (i.e., the first single power source and the second single power source) to the charging rollers 2*a* to 2*d* and to the developing rollers 43*a* to 43*d*. It is also useful to convert the voltages of respective single power sources by converters and then divide and/or reduce the converted voltages (i.e., the first converted voltage and the second converted voltage) with electronic elements having stationary voltage drop characteristics, and further input the divided and/or reduced voltages (i.e., first voltage and second voltage) to the corresponding charging rollers 2*a* to 2*d* and to the corresponding developing rollers 43*a* to 43*d*, respectively.

Further, as mentioned above, the electronic element having stationary voltage drop characteristics is usable to divide/reduce the voltage. However, performing the weak exposure-related processing according to the flowchart illustrated in FIG. 11 is effective in a case where a DC-DC converter having a specific function is provided for respective charging rollers and respective developing rollers.

More specifically, if the voltage conversion capability of the DC-DC converter is insufficient in the situation illustrated in FIG. 10A, it is unfeasible to realize the charging potential Vd_bg illustrated in FIG. 10C by solely relying on the voltage conversion capability. In such a case, it is useful to compensate the insufficient potential formed by the DC-DC converter by additionally performing the weak exposure processing in such a way as to attain the charging potential Vd_bg.

The laser driving system according to the above-mentioned exemplary embodiment can appropriately control the charging potential of each photosensitive drum, with a simplified configuration, in response to a variance or a variation in the photosensitive characteristics (i.e., EV curve characteristics) of each photosensitive drum provided in the apparatus. Thus, the laser driving system according to the above-mentioned exemplary embodiment can solve the above-mentioned problems that may occur due to the charging potential of the photosensitive drum.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-131294, filed Jun. 8, 2012, and No.

2013-099735, filed May 9, 2013 which is hereby incorporated by reference herein in its entirety.

What is claimed is:

1. An image forming apparatus capable of executing a plurality of modes for forming an image on a recording medium, among which a speed of a surface of a plurality of photosensitive members differ, the image forming apparatus comprising:

the plurality of the photosensitive members provided for each of a plurality of colors;

a plurality of charging units provided for each of a plurality of colors and configured to charge the plurality of photosensitive members;

a plurality of light irradiation units provided for each of a plurality of colors and configured to irradiate the plurality of photosensitive members charged by the charging units with light emitted from a light source to form a latent image;

a plurality of developing units provided for each of a plurality of colors and configured to form a toner image by causing toner particles to adhere to the latent image;

a control unit configured to cause the light irradiation unit to irradiate the photosensitive members at an image forming portion to which toner particles adhere with light emitted from the light source by a first light emission amount, and cause the light irradiation unit to irradiate the photosensitive members at a non-image forming portion to which no toner particles adhere with light emitted from the light source by a second light emission amount that is smaller than the first light emission amount;

an adjusting unit configured to adjust the first light emission amount and the second light emission amount; and an acquisition unit configured to acquire information relating to the speed of the surface of the photosensitive members in a mode to be executed among the plurality of modes, wherein the adjusting unit is configured to change the second light emission amount according to the information acquired by the acquisition unit wherein a power source voltage of a power source, or a converted voltage obtainable by converting the power source voltage using a converter, is applied via an element having stationary voltage drop characteristics to divide and/or reduce the voltage to the plurality of charging units corresponding to the plurality of colors and to the plurality of developing units corresponding to the plurality of colors.

2. The image forming apparatus according to claim 1, wherein the adjusting unit includes a first current adjusting unit configured to adjust a first drive current that causes the light source to emit light by the first light emission amount, and a second current adjusting unit configured to adjust a second drive current that causes the light source to emit light by the second light emission amount, wherein the second current adjusting unit is configured to change the second light emission amount by adjusting the second drive current based on the information acquired by the acquisition unit.

3. The image forming apparatus according to claim 2, wherein the first light emission amount and the second light emission amount can be independently controlled by the first current adjusting unit and the second current adjusting unit, respectively.

4. The image forming apparatus according to claim 2 executing a first mode and a second mode for forming an image on a recording medium, wherein the light irradiation unit includes a rotating polygonal mirror that has n (n is an integer equal to or greater than 3) reflection surfaces, which can reflect the light emitted from the light source of the light irradiation unit to irradiate the photosensitive members, the control unit is configured to cause the light irradiation unit to perform an m (n>m, and m is an integer equal to or greater than 1) face skipping operation in irradiating the surfaces of the rotating polygonal mirror with the light from the light source, in the second mode, the control unit is configured to set the speed of the surface of the photosensitive members to be lower than a speed in the first mode for forming image on the recording medium, and set a rotational speed of the rotating polygonal mirror to be higher than a speed in the first mode, and further set the second light emission amount to be greater than an amount in the first mode by causing the light irradiation unit to perform the face skipping control.

5. The image forming apparatus according to claim 1, wherein the light source includes a plurality of light emitting units, and the adjusting unit is configured to change the second light emission amount by deactivating a part of the plurality of light emitting units.

6. The image forming apparatus according to claim 1, wherein the adjusting unit is configured to change the first light emission amount according to the information acquired by the acquisition unit.

7. The image forming apparatus according to claim 1 further comprising:

a single power source as the power source, wherein a power source voltage of the single power source, or a converted voltage obtainable by converting the power source voltage using a converter, or a voltage obtainable by dividing and/or reducing the power source voltage or the converted voltage using an element having stationary voltage drop characteristics is applied to the plurality of charging units, and a converted voltage obtainable by converting the power source voltage using a converter, or a voltage obtainable by dividing and/or reducing the power source voltage or the converted voltage using an element having stationary voltage drop characteristics is applied to the plurality of developing units.

8. The image forming apparatus according to claim 1 further comprising:

a first single power source and a second single power source as the power source, wherein a first power source voltage of the first single power source, a first converted voltage obtainable by converting the first power source voltage using a converter, or a first voltage obtainable by dividing or reducing the first power source voltage or the first converted voltage using an element having stationary voltage drop characteristics is applied to the plurality of charging units, and wherein a second power source voltage of the second single power source, a second converted voltage obtainable by converting the second power source voltage using a converter, or a second voltage obtainable by dividing or reducing the second power source voltage or the second converted voltage using an element having stationary voltage drop characteristics is supplied to the plurality of developing units.

9. An image forming apparatus capable of executing a plurality of modes for forming an image on a recording medium, among which a speed of a surface of a photosensitive member differs, the image forming apparatus comprising:

the photosensitive member;

a charging unit configured to charge the photosensitive member;

a light irradiation unit configured to irradiate the photosensitive member charged by the charging unit with light emitted from a light source to form a latent image;

a developing unit configured to form a toner image by causing toner particles to adhere to the latent image;

a control unit configured to cause the light irradiation unit to irradiate the photosensitive member at an image forming portion to which toner particles adhere with light emitted from the light source by a first light emission amount, and cause the light irradiation unit to irradiate the photosensitive member at a non-image forming portion to which no toner particles adhere with light emitted from the light source by a second light emission amount that is smaller than the first light emission amount;

an adjusting unit configured to adjust the first light emission amount and the second light emission amount; and an acquisition unit configured to acquire information relating to the speed of the surface of the photosensitive member in a mode to be executed among the plurality of modes, wherein the adjusting unit is configured to change the second light emission amount according to the information acquired by the acquisition unit wherein the light source includes a plurality of light emitting units, and the adjusting unit is configured to change the second light emission amount by deactivating a part of the plurality of light emitting units.

10. The image forming apparatus according to claim 9, wherein the adjusting unit includes a first current adjusting unit configured to adjust a first drive current that causes the light source to emit light by the first light emission amount, and a second current adjusting unit configured to adjust a second drive current that causes the light source to emit light by the second light emission amount, wherein the second current adjusting unit is configured to change the second light emission amount by adjusting the second drive current based on the information acquired by the acquisition unit.

11. The image forming apparatus according to claim 10, wherein the first light emission amount and the second light emission amount can be independently controlled by the first current adjusting unit and the second current adjusting unit, respectively.

12. The image forming apparatus according to claim 10 executing a first mode and a second mode for forming an image on a recording medium, wherein the light irradiation unit includes a rotating polygonal mirror that has n (n is an integer equal to or greater than 3) reflection surfaces, which can reflect the light emitted from the light source of the light irradiation unit to irradiate the photosensitive members, the control unit is configured to cause the light irradiation unit to perform an m (n>m, and m is an integer equal to or greater than 1) face skipping operation in irradiating the surfaces of the rotating polygonal mirror with the light from the light source, in the second mode, the control unit is configured to set the speed of the surface of the photosensitive members to be lower than a speed in the first mode for forming image on the recording medium, and set a rotational speed of the rotating polygonal mirror to be higher than a speed in the first mode, and further set the second light emission amount to be greater than an amount in the first mode by causing the light irradiation unit to perform the face skipping control.

13. The image forming apparatus according to claim 9, wherein the adjusting unit is configured to change the first light emission amount according to the information acquired by the acquisition unit.

* * * * *